US008913925B2

(12) United States Patent
Kuramashi et al.

(10) Patent No.: US 8,913,925 B2
(45) Date of Patent: Dec. 16, 2014

(54) DEVELOPER CONVEYING DEVICE INCLUDING A PLURALITY OF PLANAR PORTIONS AND A DEVELOPING DEVICE AND IMAGE FORMING APPARATUS PROVIDED WITH SAME

(71) Applicant: KYOCERA Document Solutions Inc., Osaka-shi, Osaka (JP)

(72) Inventors: Koji Kuramashi, Osaka (JP); Yoshihiro Yamagishi, Osaka (JP); Hiroshi Yamazaki, Osaka (JP); Kuniaki Nakano, Osaka (JP); Eiji Nimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/899,619

(22) Filed: May 22, 2013

(65) Prior Publication Data

US 2013/0315629 A1 Nov. 28, 2013

(30) Foreign Application Priority Data

May 25, 2012 (JP) ..... 2012-119249

(51) Int. Cl.
*G03G 15/08* (2006.01)

(52) U.S. Cl.
CPC ..... *G03G 15/0891* (2013.01); *G03G 15/0893* (2013.01); *G03G 2215/0833* (2013.01); *G03G 2215/0838* (2013.01)
USPC ..... 399/254; 399/258; 399/263

(58) Field of Classification Search
CPC ..... G03G 2215/0827; G03G 15/0891
USPC ..... 399/254, 256, 258, 262, 263
See application file for complete search history.

(56) References Cited

U.S. PATENT DOCUMENTS 4,559,898 A * 12/1985 Fukuchi et al. ..... 399/254
5,758,238 A * 5/1998 Mordenga et al. ..... 399/256

(Continued)

FOREIGN PATENT DOCUMENTS

JP 05-035091 2/1993
JP 2004-307140 11/2004

(Continued)

OTHER PUBLICATIONS

Office Action Issued in Japanese Patent Application No. 2012-119249—Aug. 26, 2014.

*Primary Examiner* — Clayton E Laballe
*Assistant Examiner* — Trevor J Bervik
(74) *Attorney, Agent, or Firm* — Gerald E. Hespos; Michael J. Hespos; Matthew T. Hespos

(57) ABSTRACT

A developer conveying device includes a housing, a developer conveyance path and a conveying member. The developer conveyance path extends between a pair of wall portions. The conveying member includes a spiral member, an inner wall portion and shaft portions. The spiral member is formed by connecting spiral pieces, each forming one spiral turn, in a conveying direction of the developer and includes a hollow interior formed by the connected spiral pieces. The inner wall portion includes a plurality of planar portions which define the hollow interior of the spiral member and are connected at predetermined angles in a circumferential direction of the rotation of the conveying member. The shaft portions are arranged at opposite end parts of the spiral member, rotatably supported on the wall portions and serve as a rotary shaft for the rotation of the conveying member.

17 Claims, 13 Drawing Sheets

(56) References Cited

U.S. PATENT DOCUMENTS

| | | | | |
|---|---|---|---|---|
| 7,139,516 | B2 * | 11/2006 | Makino | 399/258 |
| 7,327,975 | B2 * | 2/2008 | Tanaka | 399/262 |
| 7,636,536 | B2 * | 12/2009 | Iwata et al. | 399/256 |
| 7,672,623 | B2 * | 3/2010 | Stelter et al. | 399/258 |
| 7,853,185 | B2 * | 12/2010 | Kimura et al. | 399/263 |
| 7,899,369 | B2 * | 3/2011 | Kurogawa | 399/258 |
| 7,925,189 | B2 * | 4/2011 | Norigoe | 399/256 |
| 2009/0214268 | A1 * | 8/2009 | Noh et al. | 399/258 |
| 2009/0257781 | A1 * | 10/2009 | Fuji | 399/254 |
| 2010/0196059 | A1 * | 8/2010 | Maeshima | 399/263 |
| 2011/0286769 | A1 * | 11/2011 | Mihara et al. | 399/254 |
| 2012/0014713 | A1 * | 1/2012 | Murakami et al. | 399/119 |
| 2012/0014719 | A1 | 1/2012 | Hayashi et al. | |
| 2012/0114386 | A1 * | 5/2012 | Takashima | 399/258 |

FOREIGN PATENT DOCUMENTS

| | | |
|---|---|---|
| JP | 2007-101928 | 4/2007 |
| JP | 2012-032718 | 2/2012 |

* cited by examiner

DEVELOPER CONVEYING DEVICE INCLUDING A PLURALITY OF PLANAR PORTIONS AND A DEVELOPING DEVICE AND IMAGE FORMING APPARATUS PROVIDED WITH SAME

This application is based on Japanese Patent Application Serial No. 2012-119249 filed with the Japan Patent Office on May 25, 2012, the contents of which are hereby incorporated by reference.

BACKGROUND

The present disclosure relates to a developer conveying device and a developing device and an image forming apparatus provided with the same.

Conventionally, a developing device in which an agitating screw is mounted in a developer housing is known as a developer conveying device for conveying developer. The agitating screw of the developing device is composed of a shaft portion and a spiral piece arranged around the shaft portion. In the developer housing, the developer is conveyed in a predetermined conveying direction by driving and rotating the agitating screw.

If an adhesion force of the developer increases as the developer is deteriorated, the developer may adhere to the shaft portion. If the developer adheres to the shaft portion, virtual shaft thickening of the agitating screw occurs to reduce the conveying performance of the agitating screw. An agitating screw including no shaft part, i.e. having a hollow shape in an axial central part thereof to solve the shaft thickening of the agitating screw described above is known.

With the agitating screw described above, the developer being conveyed in the hollow part of the agitating screw may aggregate in the developer housing. Such aggregation of the developer becomes notable in a high-temperature environment and when the developer is deteriorated. Particularly, in the agitating screw having the hollow shape, the developer cylindrically aggregates in some cases.

The present disclosure was developed in view of the above problem and an object thereof is to suppress the cylindrical aggregation of developer in a developer conveying member having a hollow shape.

SUMMARY

A developer conveying device according to one aspect of the present disclosure includes a housing, a developer conveyance path and a conveying member. The housing includes a pair of wall portions. The developer conveyance path extends between the pair of wall portions. The conveying member is rotatably supported on the wall portions and conveys developer from one wall portion to the other. Further, the conveying member includes a spiral member, an inner wall portion and shaft portions. The spiral member is formed by connecting spiral pieces, each forming one spiral turn, in a conveying direction of the developer and includes a hollow interior formed by the connected spiral pieces. The inner wall portion includes a plurality of planar portions which define the hollow interior of the spiral member and are connected at predetermined angles in a circumferential direction of the rotation of the conveying member. The shaft portions are arranged at opposite end parts of the spiral member, rotatably supported on the wall portions and serve as a rotary shaft for the rotation of the conveying member.

Further, a developing device according to another aspect of the present disclosure includes the above developer conveying device and a developing roller. The developing roller is rotatably supported in the housing and carries the developer.

Further, an image forming apparatus according to still another aspect of the present disclosure includes the above developing device and an image bearing member. The image bearing member is configured such that an electrostatic latent image is to be formed on a circumferential surface thereof, and arranged to face the developing roller.

These and other objects, features and advantages of the present disclosure will become more apparent upon reading the following detailed description along with the accompanying drawings.

DETAILED DESCRIPTION

Figure 1:
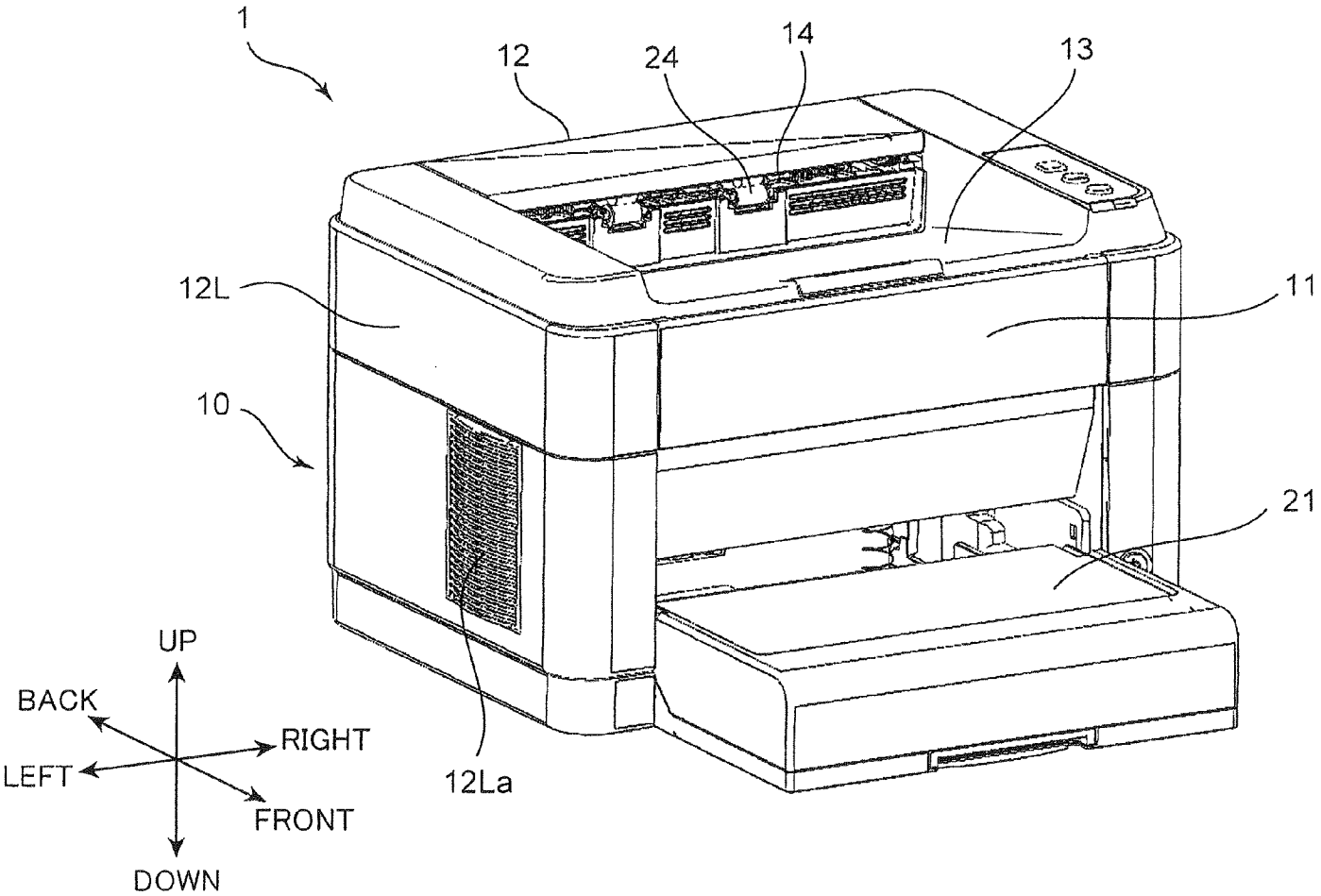
FIG. 1 is a perspective view showing the external appearance of an image forming apparatus according to one embodiment of the present disclosure.
Figure 2:
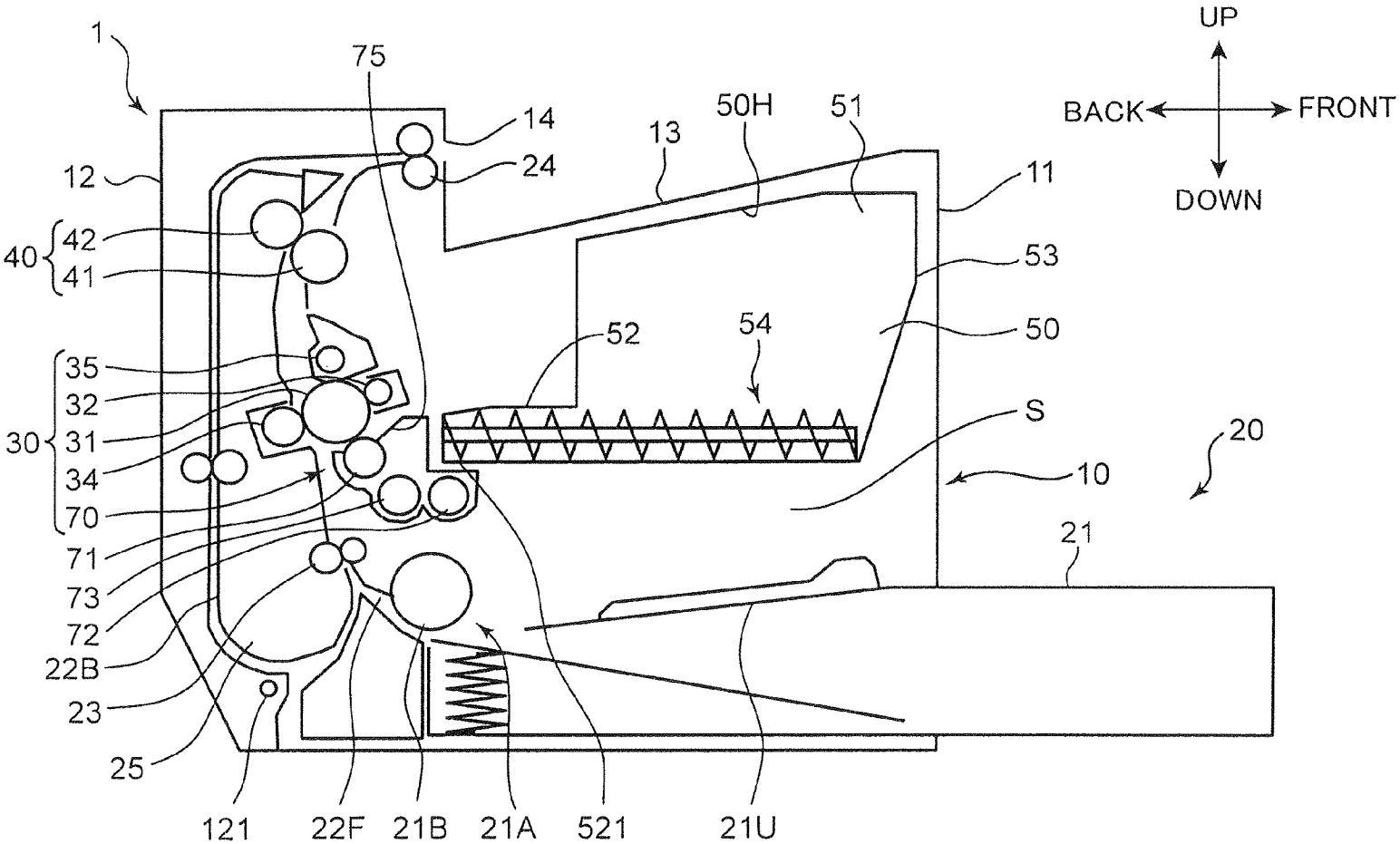
FIG. 2 is a sectional view showing the internal structure of the image forming apparatus according to the embodiment of the present disclosure.

Hereinafter, embodiments of the present disclosure are described with reference to the drawings. FIG. 1 is a perspective view showing the external appearance of an image forming apparatus 1 according to one embodiment of the present disclosure. FIG. 2 is a side view in section showing the external appearance of the image forming apparatus 1 according to one embodiment of the present disclosure. Although a black-and-white printer is illustrated as the image forming apparatus 1 here, the image forming apparatus may be a copier, a facsimile machine or a complex machine provided with these functions, or an image forming apparatus for forming a color image.

The image forming apparatus 1 includes a main body housing having a substantially rectangular parallelepipedic housing structure, and a sheet feeding unit 20, an image forming unit 30, a fixing unit 40 and a toner container 50 housed in this main body housing 10.

A front cover 11 and a rear cover 12 are respectively provided on a front surface side and a rear surface side of the main body housing 10. By opening the front cover 11, the toner container 50 is exposed to the front side. This enables a user to take out the toner container 50 from the front surface side of the main body housing 10 when toner runs out. The rear cover 12 is a cover which is opened at the time of a sheet jam or maintenance. The respective image forming unit 30 and fixing unit 40 can be taken out from the rear surface side of the main body housing 10 by opening the rear cover 12. Further, a left cover 12L (FIG. 1) and a right cover 12R (not shown in FIG. 1) opposite to the left cover 12L are respectively so arranged on side surfaces of the main body housing 10 as to extend in a vertical direction. An air inlet 12La through which air is taken into the main body housing 10 is arranged in a front part of the left cover 12L. Further, a sheet discharging portion 13 to which a sheet after image formation is to be discharged is provided on the upper surface of the main body housing 10. Various devices for performing image formation are housed in an inner space S (FIG. 2) defined by the front cover 11, the rear cover 12, the left cover 12L, the right cover 12R and the sheet discharging portion 13.

The sheet feeding unit 20 includes a sheet cassette 21 for storing sheets to which an image forming process is to be applied (FIG. 2). Apart of this sheet cassette 21 projects further forward from the front surface of the main body housing 10. The upper surface of a part of the sheet cassette 21 housed in the main body housing 10 is covered by a sheet cassette ceiling plate 21U. The sheet cassette 21 includes a sheet storage space in which a stack of the sheets is stored, a lift plate for lifting up the stack of sheets for sheet feeding, and the like. A sheet pickup unit 21A is provided above a rear end side of the sheet cassette 21. A feed roller 21B for picking up the uppermost sheet of the sheet stack in the sheet cassette 21 one by one is arranged in this sheet pickup unit 21A.

The image forming unit 30 performs an image forming process for forming a toner image on a sheet fed from the sheet feeding unit 20. The image forming unit 30 includes a photoconductive drum 31 (image bearing member) and a charging device 32, an exposure device (not shown in FIG. 2), a developing device 70, a transfer roller 34 and a cleaning device 35 arranged around this photoconductive drum 31. The image forming unit 30 is arranged between the left cover 12L and the right cover 12R.

The photoconductive drum 31 includes an unillustrated rotary shaft and a cylindrical surface (circumferential surface) which rotates about the rotary shaft. An electrostatic latent image is to be formed on this cylindrical surface and a toner image in conformity with this electrostatic latent image is to be carried on the cylindrical surface. A photoconductive drum made of an amorphous silicon (a-Si) based material can be used as the photoconductive drum 31. The photoconductive drum 31 is arranged to face a developing roller 71 to be described later.

The charging device 32 is for uniformly charging the surface of the photoconductive drum 31 and includes a charging roller held in contact with the photoconductive drum 31.

The cleaning device 35 includes an unillustrated cleaning blade and cleans the toner adhering to the cylindrical surface of the photoconductive drum 31 after the transfer of the toner image and conveys this toner to an unillustrated collecting device. Further, the photoconductive drum 31, the charging device 32 and the cleaning device 35 are integrally configured as an unillustrated drum unit.

The exposure device includes optical devices such as a laser light source, a mirror and a lens and irradiates the cylindrical surface of the photoconductive drum 31 with light modulated based on image data fed from an external apparatus such as a personal computer, thereby forming an electrostatic latent image.

The developing device 70 supplies toner to the cylindrical surface of the photoconductive drum 31 to develop the electrostatic latent image formed on the photoconductive drum 31 and form a toner image. The developing device 70 includes the developing roller 71 for bearing the toner to be supplied to the photoconductive drum 31 and a first conveyor screw 72 and a second conveyor screw 73 for conveying developer in a circulating manner while agitating the developer in an unillustrated developer housing. Note that the developing device 70 is described in detail later.

The transfer roller 34 is a roller for transferring the toner image formed on the cylindrical surface of the photoconductive drum 31 onto a sheet. The transfer roller 34 forms a transfer nip portion by coming into contact with the cylindrical surface of the photoconductive drum 31. A transfer bias having a polarity opposite to that of the toner is applied to this transfer roller 34.

The fixing unit 40 performs a fixing process for fixing a transferred toner image onto a sheet. The fixing unit 40 includes a fixing roller 41 internally provided with a heat source and a pressure roller 42 pressed in contact with this fixing roller 41 and forming a fixing nip portion between the fixing roller 41 and itself. When a sheet having a toner image transferred thereto is passed through the fixing nip portion, the toner image is fixed onto the sheet by heating by the fixing roller 41 and pressing by the pressure roller 42.

The toner container 50 stores the toner to be supplied to the developing device 70. The toner container 50 includes a container main body 51 as a main storage part for the toner, a tubular portion 52 projecting from a lower part of one side surface of the container main body 51, a lid member 53 covering the other side surface of the container main body 51, and a rotary member 54 housed in the container for conveying the toner. The toner stored in the toner container 50 is supplied into the developing device 70 through a toner discharge opening 521 provided on the lower surface of the leading end of the tubular portion 52 by driving and rotating the rotary member 54. Further, a container ceiling plate 50H covering an upper side of the toner container 50 is located below the sheet discharging portion 13.

A main conveyance path 22F and a reversing conveyance path 22B are provided to convey a sheet in the main body housing 10. The main conveyance path 22F extends from the sheet pickup unit 21A of the sheet feeding unit 20 to a sheet discharge opening 14 provided to face the sheet discharging portion 13 on the upper surface of the main body housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

The main conveyance path 22F extends to pass the transfer nip portion formed by the photoconductive drum 31 and the transfer roller 34 from a lower side to an upper side. Further, a pair of registration rollers 23 are arranged in a side of the main conveyance path 22F upstream of the transfer nip portion. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B, and a pair of discharge rollers 24 are arranged, for example, near the sheet discharge opening 14.

The reversing conveyance path 22B is formed between the outer side surface of a reversing unit 25 and the inner surface of the rear cover 12 of the main body housing 10. Note that the transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the reversing conveyance path 22B, the rear cover 12 is opened. If a sheet jam occurs in the main conveyance path 22F or if the unit including the photoconductive drum 31 or the developing device 70 is taken out to the outside, the reversing unit 25 is also opened in addition to the rear cover 12.

<Detailed Configuration of Developing Device>

Figure 3B:
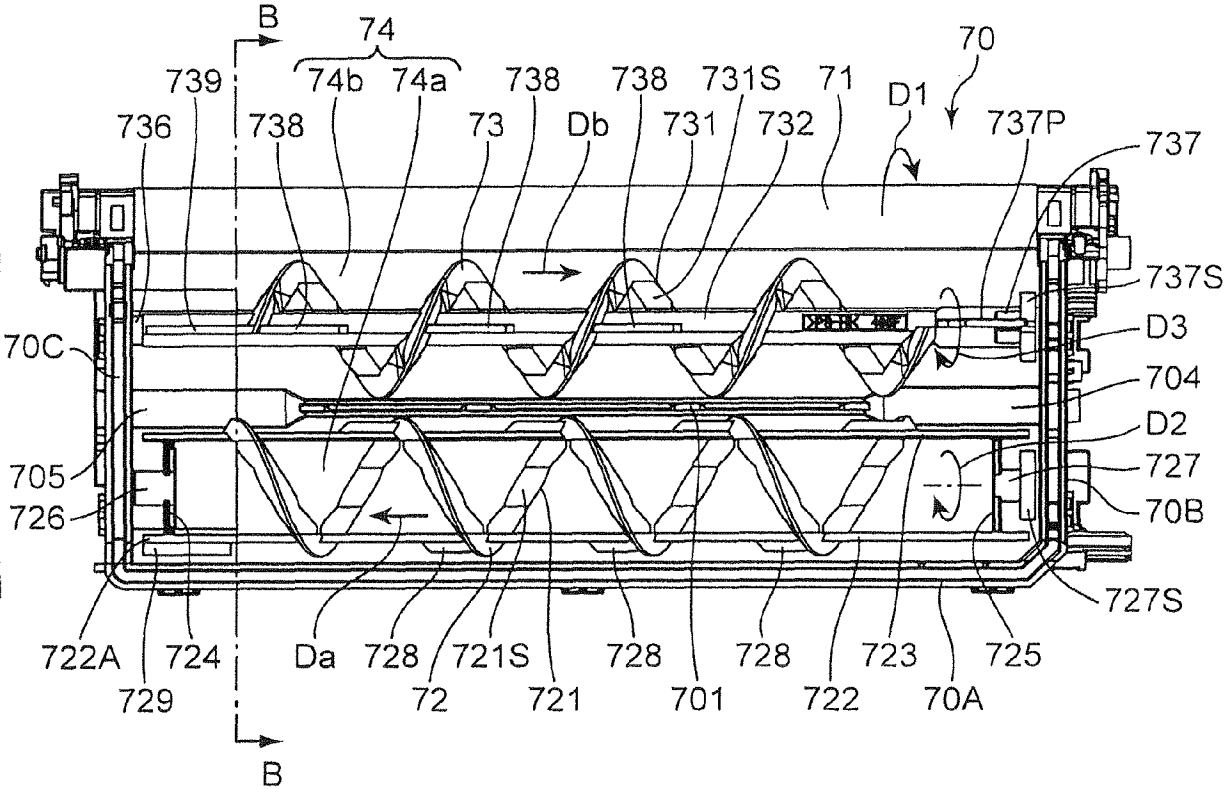
FIG. 3A is a sectional view and FIG. 3B is a plan view showing the internal structure of a developing device according to the embodiment of the present disclosure.
Figure 3A:
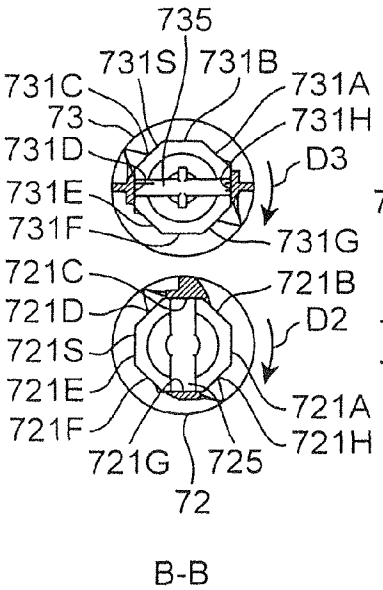

Next, with reference to FIG. 3, the configuration of the developing device 70 according to this embodiment is described in detail. FIG. 3A is a sectional view of the first and second conveyor screws 72, 73 arranged in the developing device 70 and FIG. 3B is a plan view of a developer housing 70A of the developing device 70. Note that FIG. 3B shows a state where a lid portion (not shown) of the developer housing 70A is removed.

The developing device 70 includes the developer housing 70A (housing) defining an inner space of the developing device 70. The developer housing 70A includes the unillustrated lid portion for covering respective rollers housed therein from above and a bottom portion connected to the lid portion and forming a lower surface portion of the developer housing 70A. Note that a bottom side of the developer housing 70A appears in FIG. 3B. The developer housing 70A includes a first wall portion 70B and a second wall portion 70C which are a pair of wall portions.

This developer housing 70A includes a developer storage 74 which is a cavity for storing developer composed of magnetic toner and capable of conveying the developer while agitating it. Further, the developing roller 71, a developer restricting blade 75 (FIG. 2) arranged to face the developing roller 71 and the first and second conveyor screws 72, 73 for agitating and conveying the developer are arranged in the developer housing 70A.

The developer storage 74 includes two adjacent first and second conveying portions 74*a*, 74*b* (both are developer conveyance paths) extending in a longitudinal direction of the developing device 70 between the first and second wall portions 70B, 70C. The first and second conveying portions 74*a*, 74*b* are partitioned from each other by a partition plate 701 formed integrally to the bottom portion of the developer housing 70A and extending in the longitudinal direction. Further, the first and second conveying portions 74*a*, 74*b* communicate with each other via a first communicating portion 704 and a second communicating portion 705 at opposite end parts in the longitudinal direction (see FIG. 3).

The first conveyor screw 72 (conveying member) and the second conveyor screw 73 (conveying member) are respectively housed in the first conveying portion 74*a* and the second conveying portion 74*b* and agitate and convey the developer by being rotated about shafts. Specifically, the first and second conveyor screws 72, 73 are rotatably supported on the first and second wall portions 70B, 70C and convey the developer from one of the first and second wall portions 70B, 70C toward the other. In FIG. 3A, the first conveyor screw 72 is driven and rotated in a direction of an arrow D2. On the other hand, the second conveyor screw 73 is driven and rotated in a direction of an arrow D3. The first and second conveyor screws 72, 73 are so set that developer conveying directions thereof are opposite to each other in an axial direction. This causes the developer to be conveyed in a circulating manner between the first and second conveying portions 74*a*, 74*b* as shown by arrows Da, Db in FIG. 3B while being agitated.

The developing roller 71 is arranged along the longitudinal direction of the developing device 70 and rotatably supported in the developer housing 70A. The developing roller 71 is arranged along the second conveyor screw 73. In FIG. 3B, the developing roller 71 is driven and rotated in a direction of an arrow D1. A fixed so-called magnet roll is arranged in the developing roller 71. The magnet roll includes a plurality of magnetic poles. The developer is supplied from the second conveyor screw 73 to the circumferential surface of the developing roller 71. Then, the developer carried on the circumferential surface of the developing roller 71 is conveyed to a downstream side in a rotation direction of the developing roller 71 as the developing roller 71 is rotated.

In a circumferential direction of the developing roller 71, the developer restricting blade 75 (FIG. 2) is arranged downstream of an area, where the developing roller 71 and the second conveyor screw 73 are facing each other, in the rotation direction of the developing roller 71. The developer restricting blade 75 extends in an axial direction of the developing roller 71 on the unillustrated lid portion of the developer housing 70A. The developer restricting blade 75 is a plate-like member, a leading end part of which is arranged at a predetermined distance from the circumferential surface of the developing roller 71. The thickness of a layer of the developer carried on the developing roller 71 is restricted by the developer restricting blade 75. The layer of the developer on the developing roller 71 restricted in thickness by the developer restricting blade 75 is conveyed to apart where the developing roller 71 and the photoconductive drum 31 are facing each other, and supplied to the cylindrical surface of the photoconductive drum 31 in accordance with an electrostatic latent image formed on the photoconductive drum 31.

Figure 4:
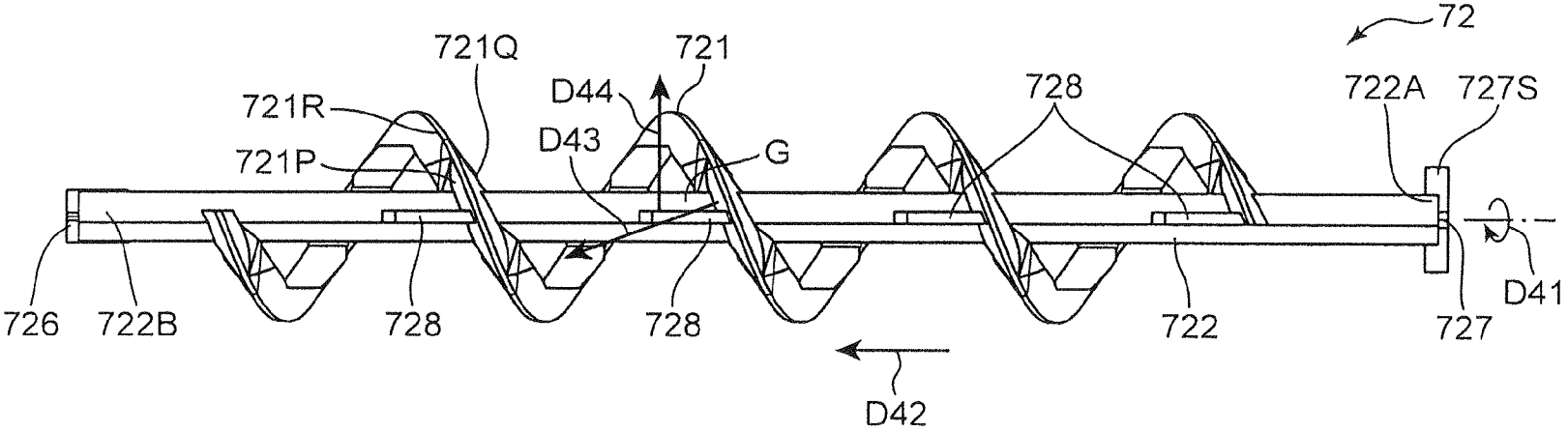
FIG. 4 is a front view of a conveyor screw according to the embodiment of the present disclosure.
Figure 5:
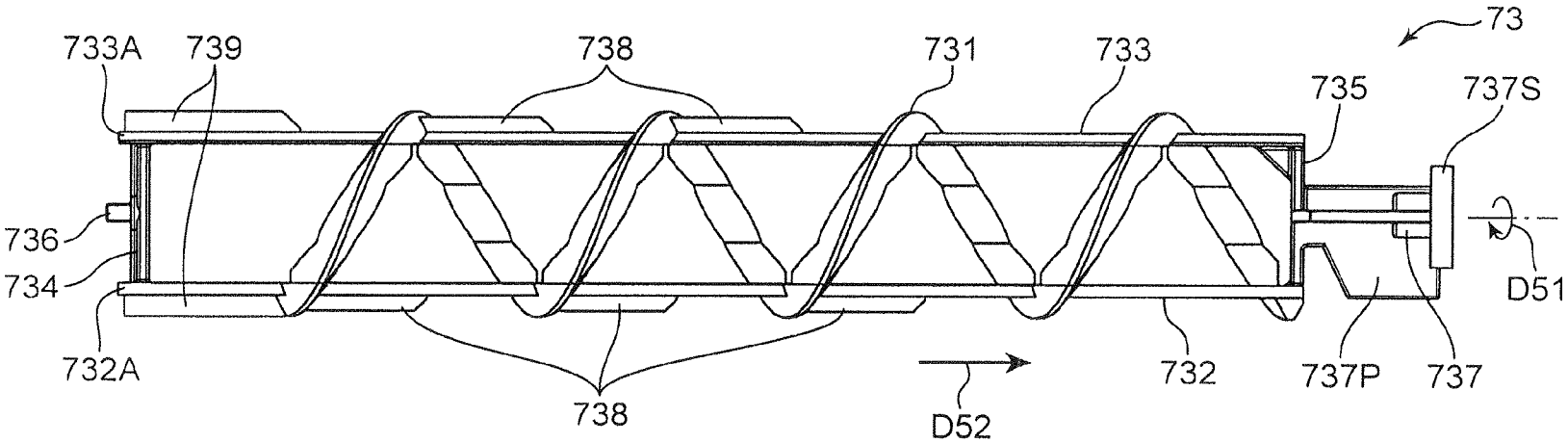
FIG. 5 is a plan view of a conveyor screw according to the embodiment of the present disclosure.
Figure 6:
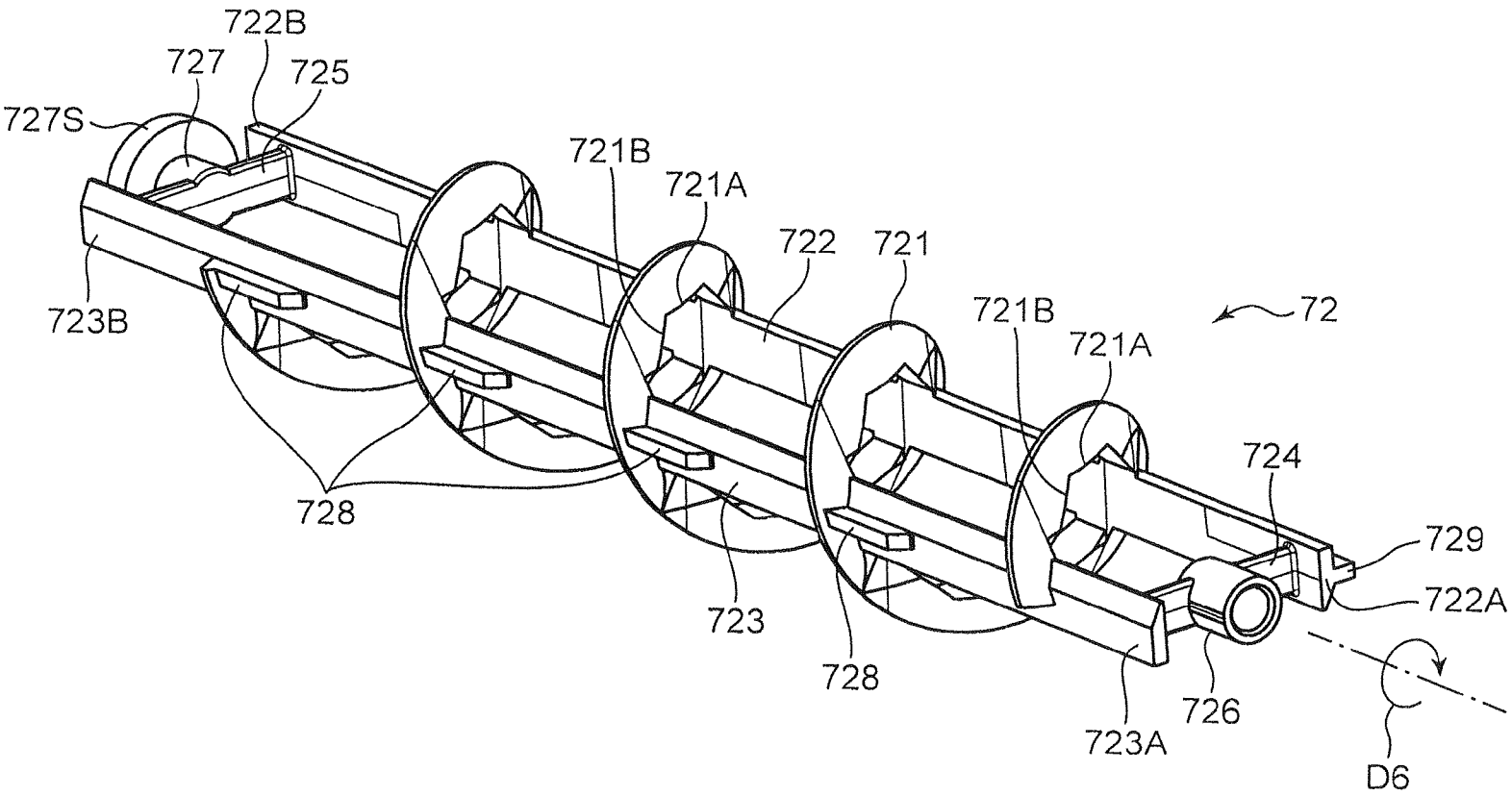
FIG. 6 is a perspective view of the conveyor screw according to the embodiment of the present disclosure.
Figure 7:
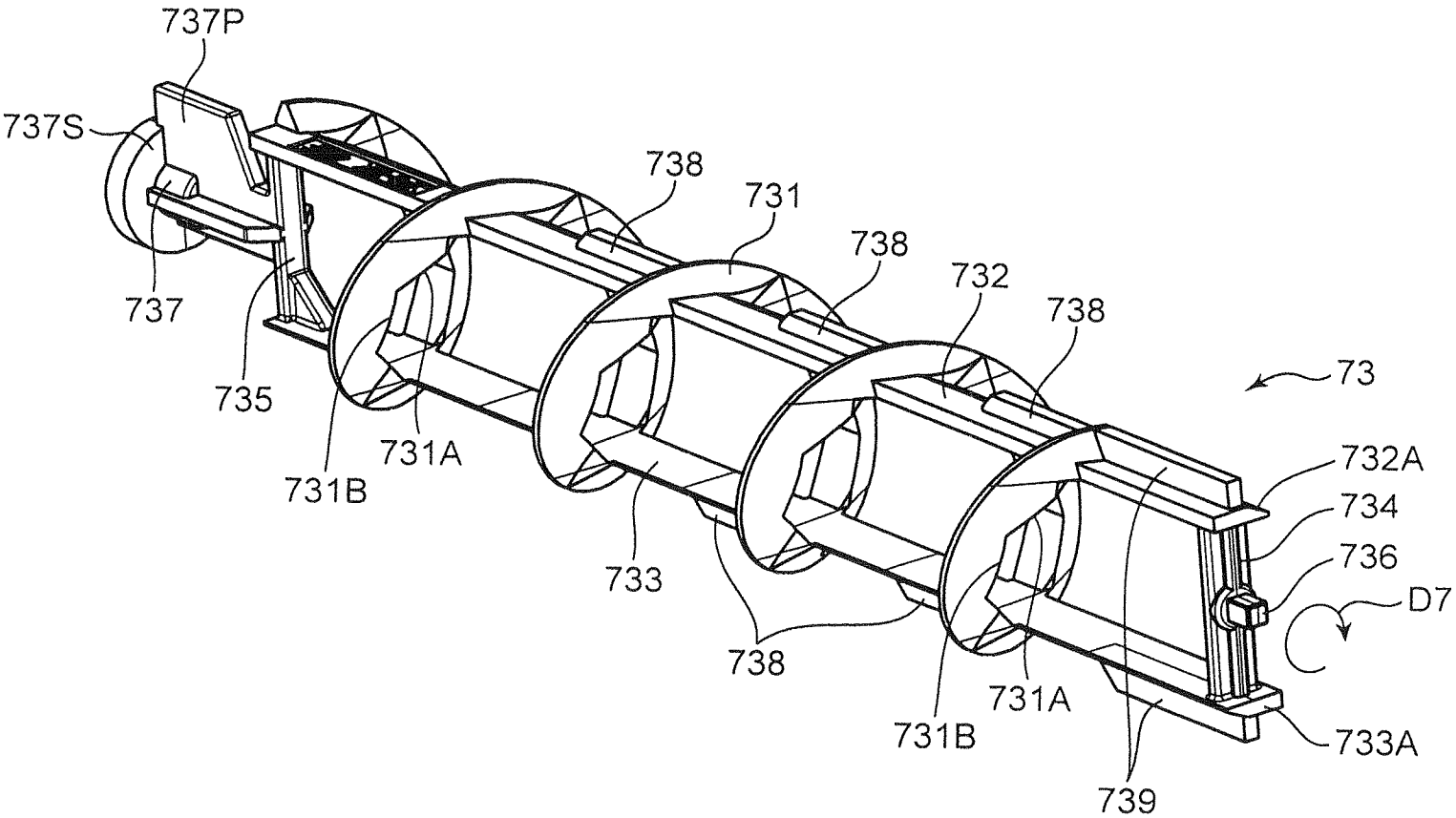
FIG. 7 is a perspective view of the conveyor screw according to the embodiment of the present disclosure.

Next, the first and second conveyor screws 72, 73 arranged in the developing device 70 according to this embodiment are described in detail with reference to FIGS. 4 to 7 in addition to FIG. 3. FIG. 4 is a front view of the first conveyor screw 72, and FIG. 5 is a plan view of the second conveyor screw 73. FIGS. 6 and 7 are respectively perspective views of the first and second conveyor screws 72, 73. In FIG. 4, the first conveyor screw 72 is rotated in a direction of an arrow D41 and the developer is conveyed in a direction of an arrow D42. Similarly, in FIG. 5, the second conveyor screw 73 is rotated in a direction of an arrow D51 and the developer is conveyed in a direction of an arrow D52. Further, in FIGS. 6 and 7, the first and second conveyor screws 72, 73 are respectively rotated in directions of arrows D6, D7.

<Regarding First Conveyor Screw 72>

The first conveyor screw 72 (conveying member) is described with reference to FIGS. 3A, 3B, 4 and 6. As described above, the first conveyor screw 72 is arranged in the first conveying portion 74*a*. The first conveyor screw 72 includes an $11^{th}$ shaft portion 726, a $12^{th}$ shaft portion 727, an $11^{th}$ rib 722, a $12^{th}$ rib 723, an $11^{th}$ connecting piece 724, a $12^{th}$ connecting piece 725, a first screw 721 and a first seal 727S.

The $11^{th}$ shaft 726 (shaft portion) and the $12^{th}$ shaft portion 727 (shaft portion) are respectively rotatably supported on the second and first wall portions 70C and 70B. The $11^{th}$ and $12^{th}$ shaft portions 726, 727 are shaft parts which serve as a rotary shaft of the first conveyor screw 72. The $11^{th}$ and $12^{th}$ shaft portions 726, 727 are arranged on one end side and the other end side (opposite end parts) of the first conveyor screw 72 (first screw 721) in the axial direction and respectively rotatably support the first conveyor screw 72. The $11^{th}$ shaft portion 726 includes a cylindrical bearing portion inside. An unillustrated projection projecting from the second wall portion 70C of the developer housing 70A toward the first conveying portion 74*a* is inserted into the bearing portion of the $11^{th}$ shaft portion 726. Similarly, the $12^{th}$ shaft portion 727 includes a cylindrical bearing portion inside. An unillustrated projection projecting from the first wall portion 70B of the developer housing 70A toward the first conveying portion 74*a* is inserted into the bearing portion of the $12^{th}$ shaft portion 727. As a result, the first conveyor screw 72 is rotatably supported in the developer housing 70A. At this time, a virtual rotary shaft of the first conveyor screw 72 is formed between the $11^{th}$ and $12^{th}$ shaft portions 726, 727 in the axial direction of the first conveyor screw 72.

The $11^{th}$ rib 722 (rib member) and the $12^{th}$ rib 723 (rib member) are plate-like members respectively extending from one end side to the other end side of the first conveyor screw 72. Further, the $11^{th}$ and $12^{th}$ ribs 722, 723 are plate-like members having a predetermined width in a circumferential direction of the first conveyor screw 72. The $11^{th}$ and $12^{th}$ ribs 722, 723 are arranged in parallel to face each other with the rotary shaft of the first conveyor screw 72 as a center. In other words, the $11^{th}$ and $12^{th}$ ribs 722, 723 are arranged at an interval of 180° in the circumferential direction of the first conveyor screw 72. The $11^{th}$ and $12^{th}$ ribs 722, 723 extend from the vicinity of the $11^{th}$ shaft portion 726 to the vicinity of the $12^{th}$ shaft portion 727 in the axial direction of the first conveyor screw 72. The $11^{th}$ and $12^{th}$ ribs 722, 723 have a function of supporting the first screw 721 to be described later and agitating the developer in the first conveying portion 74*a*.

The $11^{th}$ connecting piece 724 is arranged to face the second wall portion 70C and connects end parts of the $11^{th}$ and $12^{th}$ ribs 722, 723 at one end side in a radial direction of the first conveyor screw 72. Further, the $11^{th}$ shaft portion 726 described above projects axially outward of the first conveyor screw 72 from a central part of the $11^{th}$ connecting piece 724. In other words, the $11^{th}$ connecting piece 724 connects the end parts of the $11^{th}$ and $12^{th}$ ribs 722, 723 in the conveying direction to the $11^{th}$ shaft portion 726. Similarly, the $12^{th}$ connecting piece 725 connects end parts of the $11^{th}$ and $12^{th}$ ribs 722, 723 at the other end side in the radial direction of the first conveyor screw 72. Further, the $12^{th}$ shaft portion 727 described above projects axially outward of the first conveyor screw 72 from a central part of the $12^{th}$ connecting piece 725.

The $11^{th}$ rib 722 includes an $11^{th}$ leading end portion 722A at the outer side of the $11^{th}$ connecting piece 724 in the axial direction of the first conveyor screw 72. The $11^{th}$ leading end portion 722A is formed since one end of the $11^{th}$ rib 722 projects more axially outward (toward the second wall portion 70C) than the $11^{th}$ connecting piece 724. Further, the $11^{th}$ rib 722 includes an $11^{th}$ rear end portion 722B at the outer side of the $12^{th}$ connecting piece 725 in the axial direction of the first conveyor screw 72. The $11^{th}$ rear end portion 722B is formed since the other end of the $11^{th}$ rib 722 projects more axially outward (toward the first wall portion 70B) than the $12^{th}$ connecting piece 725.

Similarly, the $12^{th}$ rib 723 includes a $12^{th}$ leading end portion 723A at the outer side of the $11^{th}$ connecting piece 724 in the axial direction of the first conveyor screw 72. The $12^{th}$ leading end portion 723A is formed since one end of the $12^{th}$ rib 723 projects more axially outward than the $11^{th}$ connecting piece 724. Further, the $12^{th}$ rib 723 includes a $12^{th}$ rear end portion 723B at the outer side of the $12^{th}$ connecting piece 725 in the axial direction of the first conveyor screw 72. The $12^{th}$ rear end portion 723B is formed since the other end of the $12^{th}$ rib 723 projects more axially outward than the $12^{th}$ connecting piece 725.

The first screw 721 (spiral member) spirally extends in the developer conveying direction and forms the outer peripheral edge of the first conveyor screw 72. Specifically, the first screw 721 is formed by connecting spiral pieces, each forming one spiral turn, in the conveying direction. The first screw 721 includes a hollow interior formed by the spiral pieces connected to each other. In other words, the first screw 721 is a spiral conveying member which is arranged between the $11^{th}$ and $12^{th}$ shaft portions 726, 727 with a gap formed in the radial direction between the first screw 721 and the virtual rotary shaft of the first conveyor screw 72 and includes the hollow interior. The $11^{th}$ and $12^{th}$ ribs 722, 723 bridge adjacent ones of the spiral pieces of the first screw 721. In other words, the first screw 721, the $11^{th}$ rib 722 and the $12^{th}$ rib 723 are so configured that the first screw 721 is composed of a plurality of the spiral pieces and these plurality of spiral pieces are united by the pair of $11^{th}$ and $12^{th}$ ribs 722, 723, with the result that the spiral first screw 721 having a hollow part at an axial center side is formed. Note that, as shown in FIGS. 3B, 4 and 6, areas where the first screw 721 is not arranged are present at opposite axial end parts of the $11^{th}$ and $12^{th}$ ribs 722, 723.

With reference to FIG. 4, a spiral part of the first screw 721 is composed of a ridge part 721R forming the outer peripheral edge of the first screw 721 having a maximum diameter and a pair of inclined surfaces 721P, 721Q extending from the ridge part 721R to respectively face one and the other axial end sides in a cross-section including the rotary shaft of the first conveyor screw 72.

Further, a plurality of planar portions connected in the circumferential direction of the first conveyor screw 72 are arranged on the inner side of the spiral part of the first screw 721. Specifically, on the inner side (underside) of the ridge part 721R of the first screw 721, the pair of inclined surfaces 721P, 721Q are connected by the planar portions. The planar portions are arranged on the inner side of the ridge part 721R while being bent at predetermined angles along the axial direction of the first conveyor screw 72.

In other words, a first inner wall portion 721S (inner wall portion) is arranged on an inner peripheral part of the first screw 721. The first inner wall portion 721S faces the hollow interior of the first screw 721 and is formed such that a plurality of planar portions are connected at predetermined angles in the circumferential direction. The first inner wall portion 721S is composed of an $11^{th}$ inner wall surface 721A, a $12^{th}$ inner wall surface 721B, a $13^{th}$ inner wall surface 721C, a $14^{th}$ inner wall surface 721D, a $15^{th}$ inner wall surface 721E, a $16^{th}$ inner wall surface 721F, a $17^{th}$ inner wall surface 721G and an $18^{th}$ inner wall surface 721H (all are planar portions). These form a substantially regular octagonal shape in a cross-section intersecting with the axial direction of the first conveyor screw 72 as shown in FIG. 3A. Specifically, these plurality of inner wall surfaces are connected at a plurality of connecting portions (parts where the respective inner wall surfaces intersect) in the circumferential direction. The plurality of connecting portions connect the plurality of inner wall surfaces at the same angle (constant angle). Note that the $13^{th}$ and $17^{th}$ inner wall surfaces 721C, 721G respectively correspond to inner surface portions of the $12^{th}$ and $11^{th}$ ribs 723, 722. Specifically, the inner surface portions of the plate-like $12^{th}$ and $11^{th}$ ribs 723, 722 facing the hollow interior form some of the plurality of inner wall surfaces of the first screw 721.

The first seal 727S is a circular ring-shaped elastic member arranged radially outward of the 12th shaft portion 727. The first seal 727S is held in contact with an inner wall portion of the first wall portion 70B of the developer housing 70A in a state where the first screw 721 is mounted in the developer housing 70A. As a result, the first seal 727S suppresses the aggregation of the developer between the 12th shaft portion 727 and the inner wall portion of the first wall portion 70B according to the rotation of the first conveyor screw 72.

Further, the first conveyor screw 72 includes 11th projections 728 and a 12th projection 729.

The 11th projections 728 are wall portions radially projecting from radially outer wall parts of the 11th and 12th ribs 722, 723. The 11th projections 728 project up to a height slightly inwardly of the outer peripheral edge of the first screw 721 in the radial direction of the first conveyor screw 72. Further, a base end part of the 11th projection 728 is connected to one blade part of the first screw 721 in the axial direction of the first conveyor screw 72. The other end part of 11th projection 728 is arranged between another blade part arranged adjacent to the one blade part of the first screw 721 and the one blade part. In other words, the first projection 728 extends from the one blade part of the first screw 721 in a direction (arrow Da of FIG. 3B, arrow D42 of FIG. 4) in which the first conveyor screw 72 conveys the developer in the first conveying portion 74*a*. At this time, a leading end part of the 11th projection 728 in its extending direction is arranged substantially in a central part between the above two blade parts without being connected to the other blade part arranged adjacent to the one blade part.

Similarly, the 12th projection 729 (FIG. 6) is a wall portion radially projecting from a radially outer wall part of the 11th rib 722. The 12th projection 729 is arranged to have a predetermined length in the axial direction on an end part of the 11th rib 722 at the side of the 11th shaft portion 726. An axial outer end part of the 12th projection 729 is arranged to be flush with that of the 11th leading end portion 722A.

<Regarding Second Conveyor Screw 73>

Next, the second conveyor screw 73 is described with reference to FIGS. 3A, 3B, 5 and 7. Note that since the shape of the second conveyor screw 73 is similar to that of the first conveyor screw 72, parts common to the first conveyor screw 72 are not described and points of difference from the first conveyor screw 72 are mainly described in detail. As described above, the second conveyor screw 73 is arranged in the second conveying portion 74*b*. The second conveyor screw 73 includes a $21^{st}$ shaft portion 736, a $22^{nd}$ shaft portion 737, a $21^{st}$ rib 732, a $22^{nd}$ rib 733, a $21^{st}$ connecting piece 734, a $22^{nd}$ connecting piece 735, a paddle 737P, a second screw 731 and a second seal 737S.

The $21^{st}$ and $22^{nd}$ shaft portions 736, 737 correspond to the $11^{th}$ and $12^{th}$ shaft portions 726, 727 of the first conveyor screw 72. The second conveyor screw 73 is rotatably supported in the developer housing 70A by the $21^{st}$ and $22^{nd}$ shaft portions 736, 737. At this time, a virtual rotary shaft of the second conveyor screw 73 is formed between the $21^{st}$ and $22^{nd}$ shaft portions 736, 737 in the axial direction of the second conveyor screw 73.

The $21^{st}$ and $22^{nd}$ ribs 732, 733 correspond to the $11^{th}$ and $12^{th}$ ribs 722, 723 of the first conveyor screw 72. The $21^{st}$ and $22^{nd}$ connecting pieces 734, 735 correspond to the $11^{th}$ and $12^{th}$ connecting pieces 724, 725 of the first conveyor screw 72. Note that, as shown in FIG. 5, the $22^{nd}$ connecting piece 735 is arranged axially inwardly of and at a predetermined distance from the $22^{nd}$ shaft portion 737. The $21^{st}$ and $22^{nd}$ ribs 732, 733 also extend up to an area axially inwardly of and at a predetermined distance from the $22^{nd}$ shaft portion 737 and are connected to each other by the $22^{nd}$ connecting piece 735.

The $21^{st}$ rib 732 includes a $21^{st}$ leading end portion 732A at the outer side of the $21^{st}$ connecting piece 734 in the axial direction of the first conveyor screw 73. The $21^{st}$ leading end portion 732A is formed since one end of the $21^{st}$ rib 732 projects more axially outward (toward the second wall portion 70C) than the $21^{st}$ connecting piece 734. Similarly, the $22^{nd}$ rib 733 includes a $22^{nd}$ leading end portion 733A at the outer side of the $21^{st}$ connecting piece 734 in the axial direction of the first conveyor screw 73. The $22^{nd}$ leading end portion 733A is formed since one end of the $22^{nd}$ rib 733 projects more axially outward than the $21^{st}$ connecting piece 734. Note that the $21^{st}$ and $22^{nd}$ ribs 732, 733 of the second conveyor screw 73 extend until they intersect with the $22^{nd}$ connecting piece 735 and do not extend more axially outward than the $22^{nd}$ connecting piece 735 unlike the first conveyor screw 72.

The paddle 737P is a plate-like member arranged axially outwardly of the $22^{nd}$ connecting piece 735. The paddle 737P radially extends from the rotary shaft of the second conveyor screw 73. In this embodiment, the paddle 737P projects in a direction toward a position where the $21^{st}$ rib 732 is arranged in the circumferential direction of the second conveyor screw 73. The $22^{nd}$ shaft portion 737 is connected to an axially outer part of the paddle 737P. Further, the second seal 737S is connected to an axially outer end edge of the paddle 737P. The paddle 737P has a function of transferring the developer from the second conveying portion 74*b* to the first conveying portion 74*a* via the first communicating portion 704.

The second screw 731 corresponds to the first screw 721 of the first conveyor screw 72. The shape of the second screw 731 in a cross-section including the rotary axis of the second conveyor screw 73 is also similar to the first conveyor screw 72.

Particularly, with reference to FIG. 3A, a second inner wall portion 731S is arranged on an inner peripheral part of the second screw 731. The second inner wall portion 731S is formed such that a plurality of planar portions are connected at predetermined angles. The second inner wall portion 731S is composed of a 21st inner wall surface 731A, a 22nd inner wall surface 731B, a 23rd inner wall surface 731C, a 24th inner wall surface 731D, a 25th inner wall surface 731E, a 26th inner wall surface 731F, a 27th inner wall surface 731G and a 28th inner wall surface 731H. These form a substantially regular octagonal shape in a cross-section intersecting with the axial direction of the second conveyor screw 73 as shown in FIG. 3A. Note that the 24th and 28th inner wall surfaces 731D, 731H respectively correspond to inner surface portions of the plate-like 22nd and 21st ribs 733, 732.

The second seal 737S is a circular ring-shaped elastic member arranged radially outward of the 22nd shaft portion 737. The second seal 737S is held in contact with an inner wall portion of the first wall portion 70B of the developer housing 70A in a state where the second conveyor screw 73 is mounted in the developer housing 70A. As a result, the second seal 737S suppresses the aggregation of the developer between the 22nd shaft portion 737 and the inner wall portion of the first wall portion 70B according to the rotation of the second conveyor screw 73.

Further, the second screw 731 includes 21st projections 738 and 22nd projections 739. The 21st projections 738 correspond to the 11th projections 728 of the first conveyor screw 72.

On the other hand, the 22nd projections 739 are a pair of wall portions radially projecting from radially outer wall parts of the 21st and 22nd ribs 732, 733. The 22nd projections 739 are arranged to have a predetermined length in the axial direction on end parts of the 21st and 22nd ribs 732, 733 at the side of the 21st shaft portion 736. Note that axial outer end parts of the 21st and 22nd leading end portions 732A, 733A project slightly more axially outward than axial outer end parts of the 22nd projections 739.

<Regarding Functions and Effects of First and Second Inner Wall Portions 721S, 731S>

Next, functions and effects of the first inner wall portion 721S of the first conveyor screw 72 according to this embodiment are described. Note that the following functions and effects are the same as with the second inner wall portion 731S of the second conveyor screw 73.

As described above, the first screw 721 of the first conveyor screw 72 is a hollow spiral conveying member. In other words, the first conveyor screw 72 has no shaft part between the $11^{th}$ shaft portion 726 and the $12^{th}$ shaft portion 727. This prevents an increase in the viscosity of the developer and the adhesion of the developer to the shaft part when the developer in the developer storage 74 is deteriorated or when an environment surrounding the developing device 70 reaches a high temperature. If developer with increased viscosity adheres to a shaft part, the conveying performance of a conveyor screw including the shaft part is reduced. The first conveyor screw 72 according to this embodiment can solve such a problem by having the above hollow shape.

On the other hand, if the fluidity of the developer decreases due to a high-temperature environment or the deterioration of the developer, the developer is more likely to stay in the hollow interior of the first screw 721. As a result, the developer may aggregate while having a cylindrical shape with a maximum outer diameter at the inner wall part of the first screw 721. Such aggregation is notable in the case of one-component developer. This is because carrier acts to suppress the aggregation of toner in the case of two-component developer composed of the toner and the carrier. Further, if the inner wall of the first screw 721 forms a curved surface continuous in the circumferential direction, the developer arranged at the inner side of this inner wall is more likely to cylindrically aggregate. On the other hand, the first conveyor screw 72 according to this embodiment includes the first inner wall portion 721S. Specifically, the first inner wall portion 721S is formed by connecting the plurality of planar portions at the predetermined angles. As shown in FIG. 3A, the first inner wall portion 721S has a substantially regular octagonal shape in the cross-section intersecting with the axial direction of the first conveyor screw 72.

According to such a first inner wall portion 721S, a pressure whose magnitude cyclically varies is applied to the developer being conveyed inside the first screw 721. Specifically, when the inner wall of the first screw 721 is viewed from the virtual rotary shaft part of the first conveyor screw 72 in the above cross-section, a trace of the inner wall of the first screw 721 changes between surface parts represented by the $11^{th}$ inner wall surface 721A and intersection parts of the plurality of surfaces according to the rotation of the first screw 721. A cross-sectional shape of the first inner wall portion 721S is not a circular shape having a uniform inner diameter, but an irregular shape having a varying diameter. Due to the irregular shape, an aggregate of the developer arranged in the hollow interior of the first screw 721 tends to collapse if the first screw 721 is rotated. As a result, even if the fluidity of the developer decreases, the first inner wall portion 721S has a function of collapsing an aggregate of the developer inside the first screw 721. Further, a pressure whose magnitude cyclically varies is applied to the developer arranged inside the first screw 721. As a result, even if the fluidity of the developer decreases, the first inner wall portion 721S has the function of collapsing an aggregate of the developer inside the first screw 721. Thus, as described above, the cylindrical aggregation of the developer inside the first screw 721 is suppressed. The second inner wall portion 731S of the second conveyor screw 73 also achieves similar functions and effects. Note that cross-sectional shapes of the first and second inner wall portions 721S, 731S are not limited to substantially regular octagonal shapes. Functions and effects similar to the above are achieved by connecting a plurality of planar parts at predetermined angles in the circumferential direction on the inner wall part of the first screw 721 or the second screw 731.

<Regarding Functions and Effects of $11^{th}$ and $12^{th}$ Leading End Portions 722A, 723A>

Figure 8:
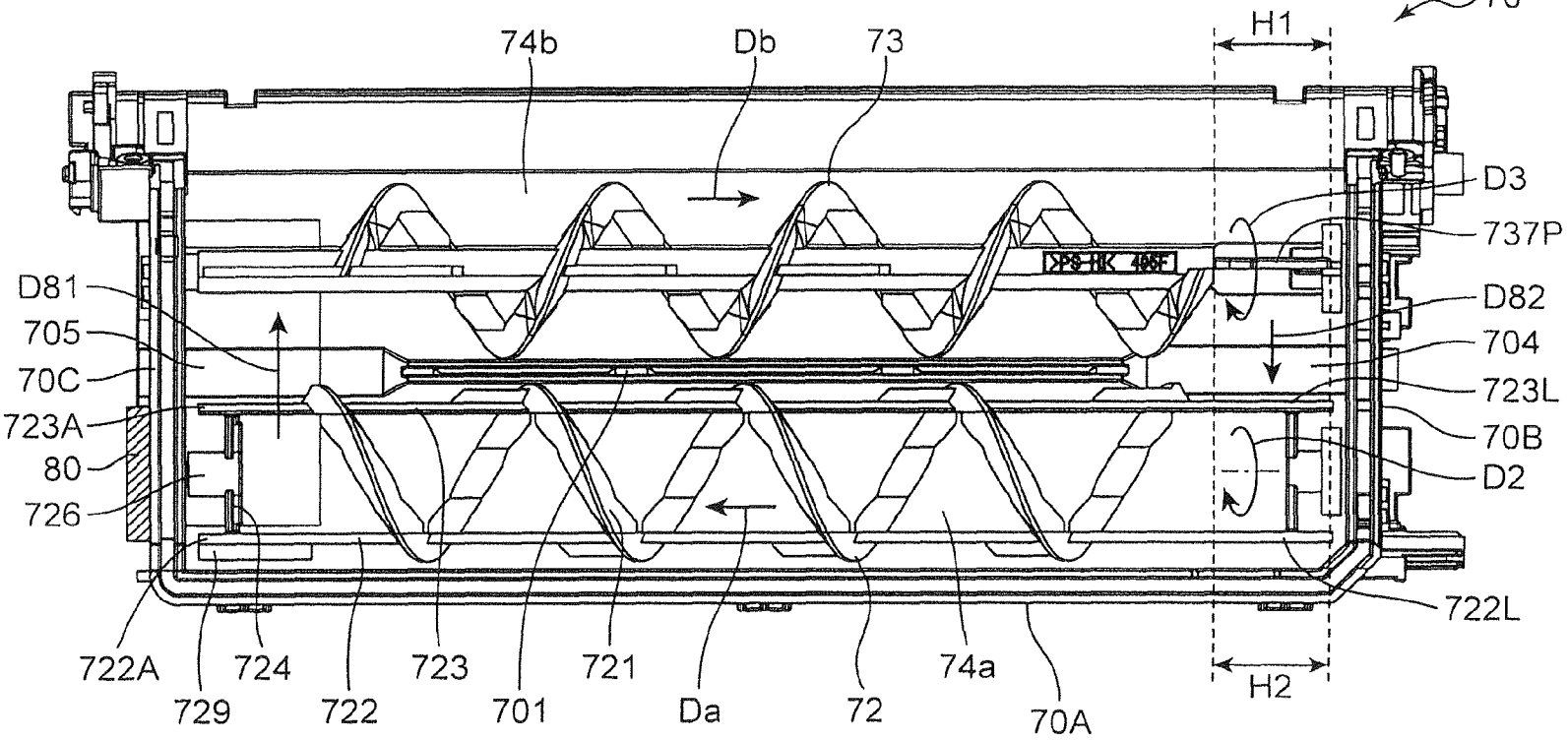
FIG. 8 is a plan view showing the internal structure of the developing device according to the embodiment of the present disclosure.

Next, functions and effects of the $11^{th}$ and $12^{th}$ leading end portions 722A, 723A are described with reference to FIGS. 3B and 8. Note that effects similar to the following ones are also achieved by the $11^{th}$ rear end portion 722B, the $12^{th}$ rear end portion 723B (FIG. 6), the $21^{st}$ leading end portion 732A and the $22^{nd}$ leading end portion 733A (FIG. 7). Similarly to FIG. 3B, FIG. 8 is a plan view of the developer housing 70A of the developing device 70 when viewed from above. As described above, the $11^{th}$ and $12^{th}$ leading end portions 722A, 723A of the first conveyor screw 72 are respectively formed since one ends of the $11^{th}$ and $12^{th}$ ribs 722, 723 project more axially outward than the $11^{th}$ connecting piece 724. The $11^{th}$ and $12^{th}$ leading end portions 722A, 723A are arranged to face the second wall portion 70C of the developer housing 70A.

The developer conveyed in a direction of an arrow Da of FIG. 8 by the first conveyor screw 72 in the first conveying portion 74*a* is moved toward the second conveying portion 74*b* at the second communicating portion 705. At this time, since the first conveyor screw 72 is rotated in a direction D2 of FIG. 8, the developer is mostly moved in the direction of the arrow Da along the partition plate 701 in the first conveying portion 74*a*. However, if the developer in the developer storage 74 is deteriorated and the fluidity thereof decreases, the developer located between the $11^{th}$ connecting piece 724 and the second wall portion 70C is less likely to join the developer moved along the partition plate 701 as described above. As a result, the developer stays between the $11^{th}$ connecting piece 724 and the second wall portion 70C. If the developer stays at a downstream end part of the first conveying portion 74*a* in this way, the transfer of the developer from the first conveying portion 74*a* to the second conveying portion 74*b* is deteriorated and a distribution of the developer in the developer storage 74 becomes uneven. Further, chargeability may vary in the developer in the developer storage 74.

Even in such a case, in this embodiment, the $11^{th}$ and $12^{th}$ leading end portions 722A, 723A projecting axially outward from the $11^{th}$ connecting piece 724 actively agitate the developer staying near the second wall portion 70C as the first conveyor screw 72 rotates. Note that if the $11^{th}$ connecting piece 724 connects axial tips of the $11^{th}$ and $12^{th}$ leading end portions 722A, 723A (if the $11^{th}$ and $12^{th}$ leading end portions 722A, 723A do not project axially outward), it strongly presses the developer staying between the $11^{th}$ connecting piece 724 and the second wall portion 70C against the second wall portion 70C. In this case, the developer staying between the $11^{th}$ connecting piece 724 and the second wall portion 70C is more likely to aggregate. Thus, the $11^{th}$ and $12^{th}$ leading end portions 722A, 723A are so arranged as to project axially outward from the 11th connecting piece 724, whereby the developer is effectively agitated. Since the fluidity of the developer being agitated increases, the developer is moved from the second communicating portion 705 to the second conveying portion 74*b* (arrow D81 of FIG. 8). At this time, the movement of the developer from the first conveying portion 74*a* to the second conveying portion 74*b* is promoted by the rotation of the 12th projection 729 of the first conveyor screw 72.

Further, in this embodiment, the developing device 70 includes a toner sensor 80 facing the first conveying portion 74*a* of the second wall portion 70C as shown in FIG. 8. The toner sensor 80 is an eddy-current sensor. The toner sensor 80 outputs a current value corresponding to a pressure applied to the second wall portion 70C by the developer (toner) distributed at the inner side of the developer storage 74 of the developer housing 70A. As a result, the amount of the developer stored in the developer storage 74 of the developer housing 70A is detected by the toner sensor 80. As described above, when the developer stays between the 11th connecting piece 724 and the second wall portion 70C, a decrease in the amount of the developer may not be detected by the toner sensor 80 even if the amount of the developer in the developer storage 74 actually decreases. In this embodiment, as described above, the developer arranged between the 11th connecting piece 724 and the second wall portion 70C is preferably agitated by the 11th and 12th leading end portions 722A, 723A. Thus, the stay of the developer is suppressed and the amount of the developer in the developer storage 74 is accurately detected. Note that a developer agitating effect similar to the above is achieved also by the 11th and 12th rear end portions 722B, 723B arranged to face the first wall portion 70B and further by the 21st and 22nd leading end portions 732A, 733A arranged to face the second wall portion 70C at the side of the second conveying portion 74*b*.

Note that, in this embodiment, the toner sensor 80 is arranged on the second wall portion 70C as described above. Thus, as described above, the projection is arranged on the inner wall portion of the second wall portion 70C and the 11th shaft portion 726 is fitted to this projection to rotatably support the first conveyor screw 72. Therefore, a bearing part of the first conveyor screw 72 does not project on an outer wall portion of the second wall portion 70C, wherefore the arrangement of the toner sensor 80 is not hindered. Further, since the 11th and 12th leading end portions 722A, 723A project at opposite sides of the 11th shaft portion 726 in the radial direction of the first conveyor screw 72, the stay of the developer is suppressed around the above projection. This prevents the developer from being clogged in the bearing part of the 11th shaft portion 726 and the rotation of the first conveyor screw 72 is preferably maintained.

<Regarding Functions and Effects of First Receiving Portion H2 (11th Screw Receiving Portion 722L, 12th Screw Receiving Portion 723L) and Second Receiving Portion K2 (21st Screw Receiving Portion 732L, 22nd Screw Receiving Portion 733L)>

Figures 9A, 9B, 9C:
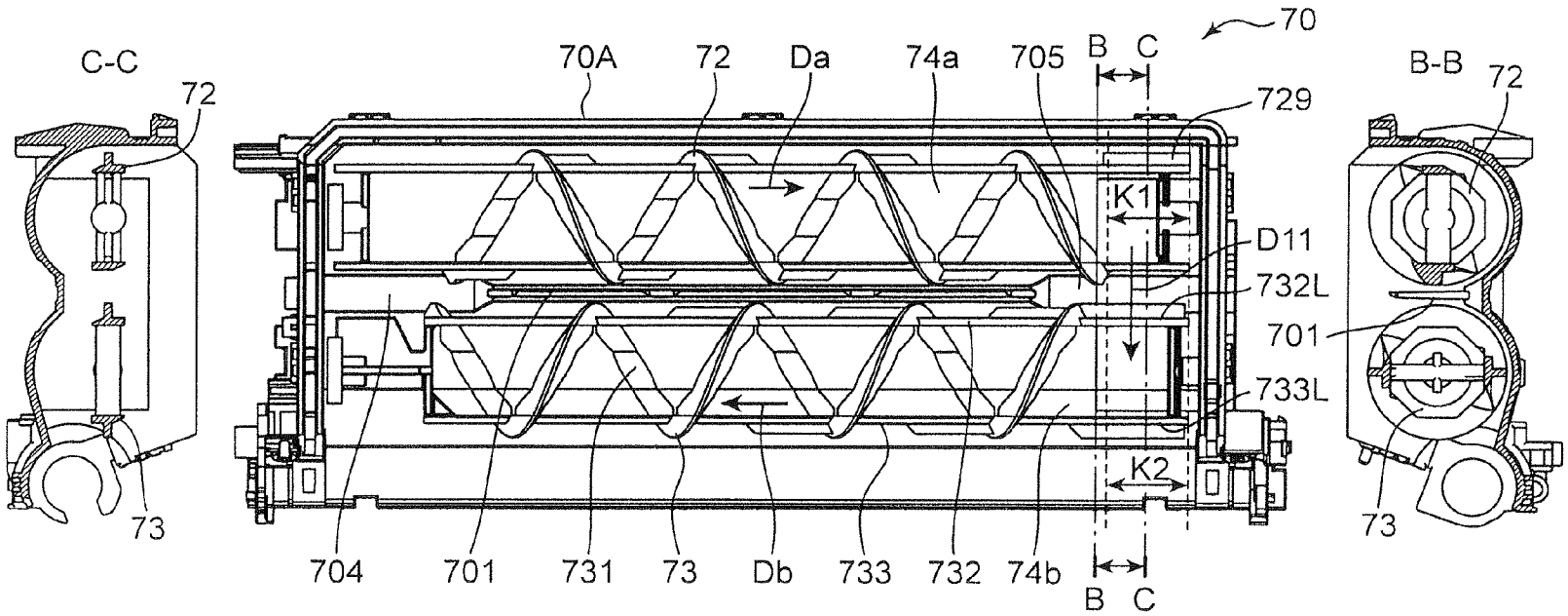
FIG. 9A is a plan view and FIGS. 9B and 9C are sectional views showing the internal structure of the developing device according to the embodiment of the present disclosure.

Next, the first and second receiving portions H2, K2 of the developing device 70 are described with reference to FIGS. 8, 9A, 9B and 9C. Similarly to FIG. 8, FIG. 9A is a plan view of the developing device 70. Note that a state shown in FIG. 9A is a vertically inverted state of a state shown in FIG. 8. Further, FIGS. 9B and 9C are respectively sectional views at positions B-B and C-C of FIG. 9A. In a state where the first and second conveyor screws 72, 73 are mounted in the developer housing 70A of the developing device 70, the first receiving portion H2 is arranged on an upstream end part of the first conveyor screw 72 in the conveying direction. Further, the second receiving portion K2 is arranged on an upstream end part of the second conveyor screw 73 in the conveying direction (FIG. 9A). With reference to FIG. 8, the first receiving portion H2 corresponds to an area of the first conveyor screw 72 facing an area H1, where the paddle 737P of the second conveyor screw 73 is arranged, in a direction perpendicular to the axial direction of the first conveyor screw 72. Parts of the 11th and 12th ribs 722, 723 corresponding to the first receiving portion H2 are respectively defined by the 11th and 12th screw receiving portions 722L, 723L. The spiral part of the first screw 721 is not arranged in the 11th and 12th screw receiving portions 722L, 723L. As a result, the developer flowed into the first communicating portion 704 from a downstream end part of the first conveying portion 74*a* by the paddle 737P of the second conveyor screw 73 is smoothly transferred to an upstream end part of the first conveying portion 74*a* (arrow D82 of FIG. 8). In other words, if the spiral part of the first screw 721 is arranged in the first receiving portion H2 of the first conveyor screw 72, the spiral part diffuses the developer in a rotation radial direction of the first conveyor screw 72. Specifically, the developer flowed in from the second conveying portion 74*b* via the first communicating portion 704 is pushed back toward the second conveying portion 74*b* by the spiral part. However, in this embodiment, the generation of a reverse flow of the developer as described above is suppressed by the first receiving portion H2 of the first conveyor screw 72 and the transfer of the developer from the second conveying portion 74*b* to the first conveying portion 74*a* is preferably realized.

Similarly, with reference to FIG. 9A, the second receiving portion K2 corresponds to an area of the second conveyor screw 73 facing an area K1, where the 12th projection 729 of the first conveyor screw 72 is arranged, in a direction perpendicular to the axial direction of the second conveyor screw 73. Parts of the 21st and 22nd ribs 732, 733 corresponding to the second receiving portion K2 are respectively defined by the 21st and 22nd screw receiving portions 732L, 733L. The spiral part of the second screw 731 is not arranged in the 21st and 22nd screw receiving portions 732L, 733L. As a result, the developer flowed into the second communicating portion 705 from a downstream end part of the first conveying portion 74*a* by the 12th projection 729 of the first conveyor screw 72 is smoothly transferred to an upstream end part of the second conveying portion 74*b* (arrow D11 of FIG. 9A). In other words, if the spiral part of the second screw 731 is arranged in the second receiving portion K2 of the second conveyor screw 73, the spiral part diffuses the developer in a rotation radial direction of the second conveyor screw 73. Specifically, the developer flowed in from the first conveying portion 74*a* via the second communicating portion 705 is pushed back toward the first conveying portion 74*a* by the spiral part. Therefore, the generation of a reverse flow of the developer as described above is suppressed by the second receiving portion K2 of the second conveyor screw 73 and the transfer of the developer from the first conveying portion 74*a* to the second conveying portion 74*b* is preferably realized.

Further, in this embodiment, areas where the first screw 721 and the second screw 731 are not arranged are present at the axial outer sides of the first and second conveyor screws 72, 73. In other words, the first and second receiving portions H2, K2 are provided. This further suppresses the cylindrical developer aggregation as described above. Specifically, by not arranging the first and second screws 721, 731 at the axial end parts of the first and second conveyor screws 72, 73, the hollow parts of the first and second conveyor screws 72, 73 are partly open. As a result, the developer arranged in the hollow interiors of the first and second screws 721, 731 is easily allowed to escape to the axial outer sides. As a result, the cylindrical developer aggregation is suppressed while the transfer of the developer between the first and second conveying portions 74*a*, 74*b* is preferably maintained.

<Regarding Functions and Effects of 11$^{th}$ Projections 728 and 21$^{st}$ Projections 738>

Figures 10A, 10B:
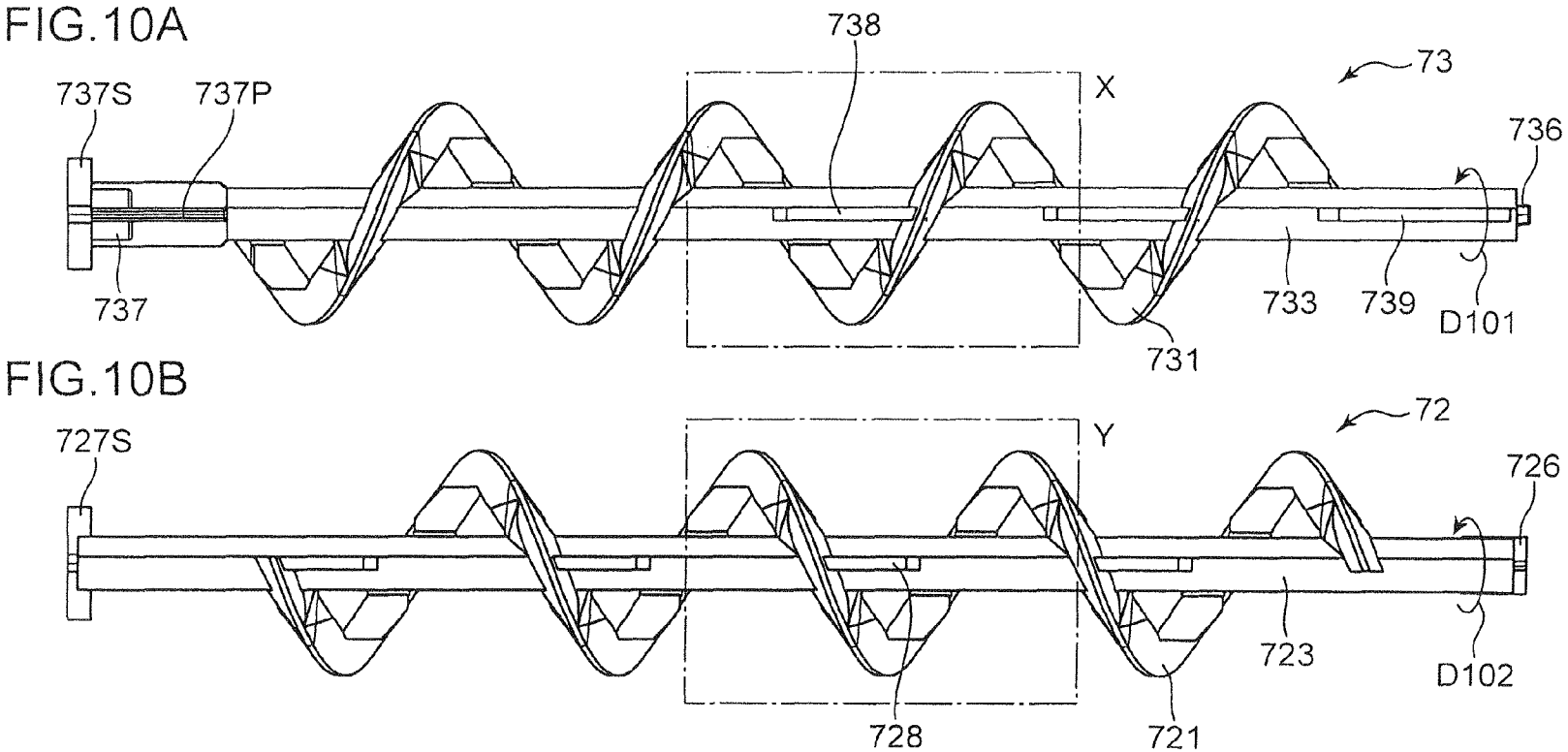
FIG. 10A is a plan view and FIG. 10B is a front view of the conveyor screws according to the embodiment of the present disclosure.
Figure 11A:
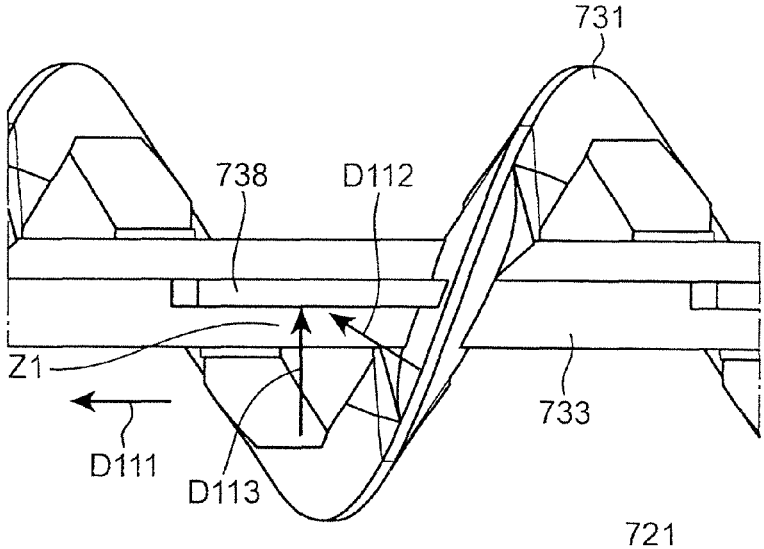
FIGS. 11A and 11B are enlarged views of the conveyor screws according to the embodiment of the present disclosure.
Figure 11B:
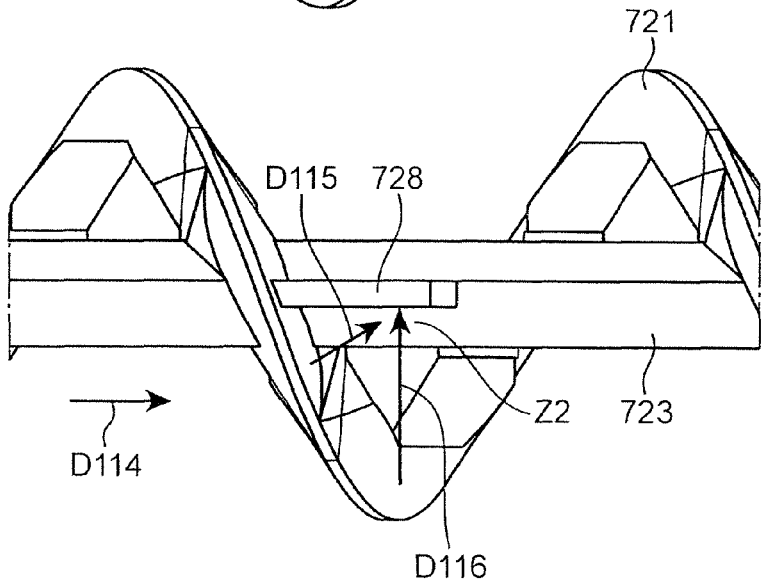
Figure 12:
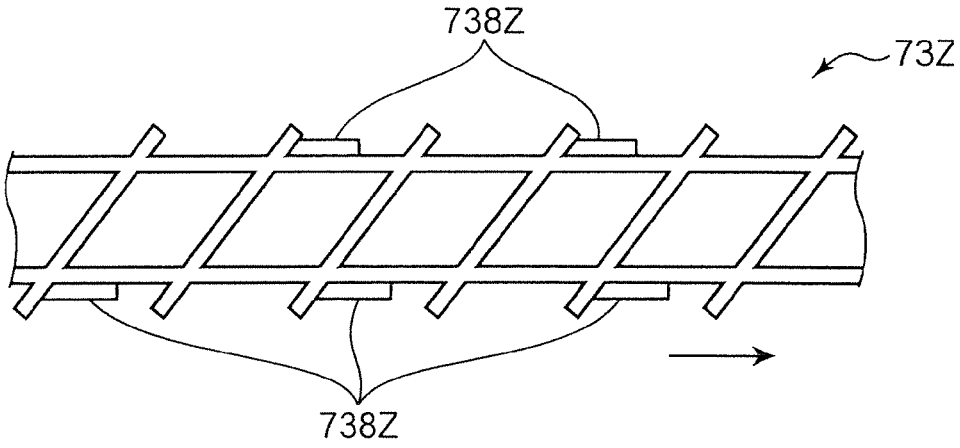
FIG. 12 is a diagram of a conveyor screw according to another embodiment of the present disclosure.
Figure 13:
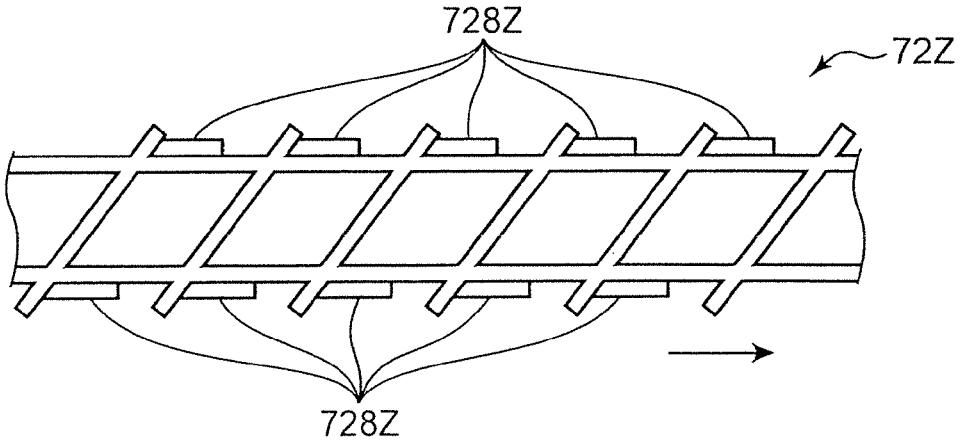
FIG. 13 is a diagram of a conveyor screw according to the other embodiment of the present disclosure.
Figure 14:
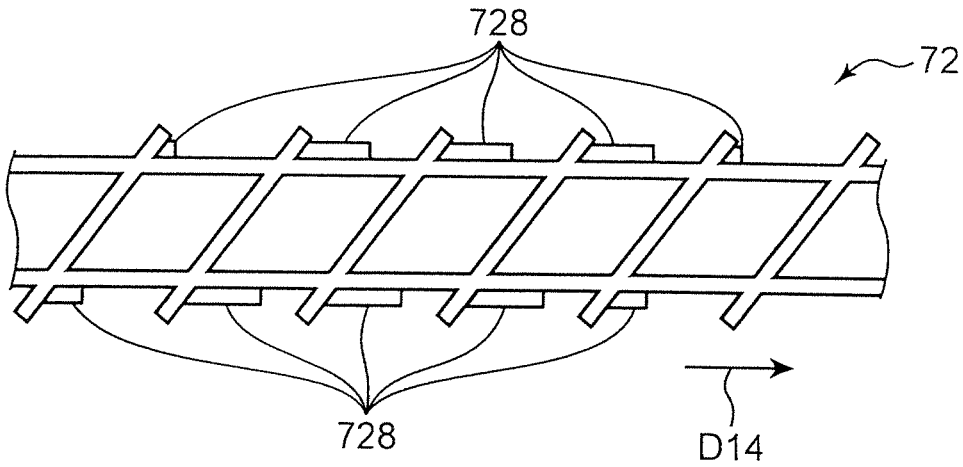
FIG. 14 is a diagram of a conveyor screw according to another embodiment of the present disclosure.
Figure 15:
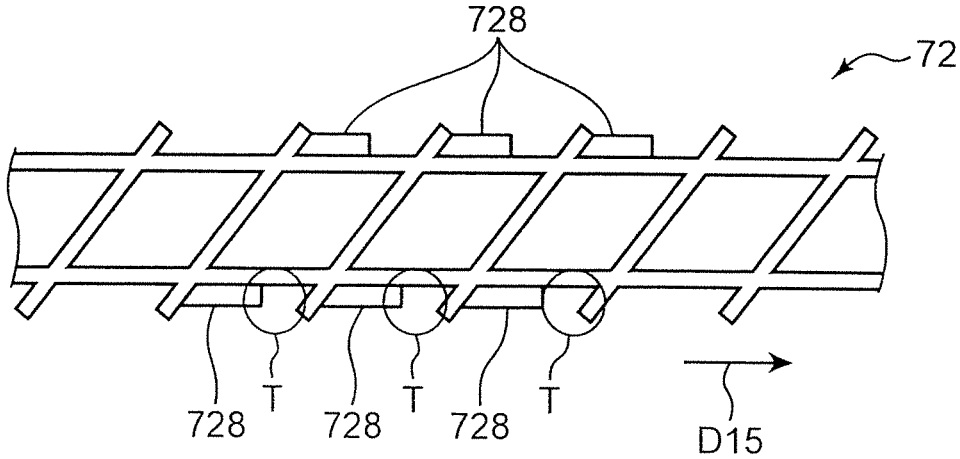
FIG. 15 is a diagram of a conveyor screw according to another embodiment of the present disclosure.

Next, functions and effects of the 11$^{th}$ and 21$^{st}$ projections 728, 738 are described with reference to FIGS. 10 to 15. FIG. 10A is a plan view of the second conveyor screw 73 and FIG. 10B is a front view of the first conveyor screw 72. In FIGS. 10A and 10B, the second and first conveyor screws 73, 72 are respectively rotated in a direction of an arrow D101 and that of an arrow D102. FIG. 11A is a view enlargedly showing an area X of FIG. 10A and FIG. 11B is a view enlargedly showing an area Y of FIG. 10B. FIG. 12 is a diagram showing the arrangement of 21$^{st}$ projections 738Z of a second conveyor screw 73Z according to another embodiment, and FIG. 13 is a diagram showing the arrangement of 11$^{th}$ projections 728Z of a first conveyor screw 72Z according to the other embodiment. FIGS. 14 and 15 are diagrams showing the shapes of 11$^{th}$ projections 728 in modifications of the present invention.

The 11$^{th}$ and 21$^{st}$ projections 728, 738 function to partly restrain the developer conveying performance in the axial directions of the first and second conveyor screws 72, 73. When the second conveyor screw 73 is driven and rotated in the direction of the arrow D101 in FIG. 10A, the developer is mainly conveyed in a direction of an arrow D111 of FIG. 11A. Out of the developer in the second conveying portion 74*b*, the developer arranged in a wedge-shaped part (Z1) between the second screw 731 and the 21$^{st}$ projection 738 is locally moved in a direction of an arrow D112 of FIG. 11A by the second screw 731. However, the developer collides with the 21$^{st}$ projection 738 and moves in a direction of an arrow D113. Specifically, a movement of the developer made in the axial direction by the second screw 731 is translated into a circumferential movement by the 21$^{st}$ projection 738. As a result, a force of axially conveying the developer arranged between the second screw 731 and the 21$^{st}$ projection 738 is reduced. Specifically, the axial conveying performance of the second conveyor screw 73 is partly restrained in correspondence with the parts where the 21$^{st}$ projections 738 are arranged in the axial direction of the second conveyor screw 73.

Similarly, as shown in FIGS. 10B and 11B, the axial conveying performance of the first conveyor screw 72 is partly restrained in correspondence with the parts where the 11$^{th}$ projections 728 are arranged in the axial direction of the first conveyor screw 72. Specifically, when the first conveyor screw 72 is driven and rotated in the direction of the arrow D102 in FIG. 10B, the developer is mainly conveyed in a direction of an arrow D114 of FIG. 11B. Out of the developer in the first conveying portion 74*a*, the developer arranged in a wedge-shaped part (Z2) between the first screw 721 and the 11$^{th}$ projection 728 is locally moved in a direction of an arrow D115 of FIG. 11B by the second screw 721. However, the developer collides with the 11$^{th}$ projection 728 and moves in a direction of an arrow D116. Specifically, a movement of the developer made in the axial direction by the first screw 721 is translated into a circumferential movement by the 11$^{th}$ projection 728.

Particularly, in this embodiment, the 21$^{st}$ projection 738 is arranged substantially in a widthwise (circumferential) central part of the 22$^{nd}$ rib 733. Thus, as shown in the area Z1, the developer is temporarily trapped in an area, three sides of which are closed by the 21$^{st}$ projection 738, the 22$^{nd}$ rib 733 and the second screw 731. As a result, the developer moved in the direction of the arrow D112 by the second screw 731 is accurately moved in the direction of the arrow D113 by the 21$^{st}$ projection 738 as described above. At this time, since a radially inward movement of the developer is suppressed by the 22$^{nd}$ rib 733, a movement of the developer into the hollow interior of the first conveyor screw 72 is suppressed. Thus, the developer conveying performance is partly reduced without increasing a pressure in the hollow part. As a result, the cylindrical developer aggregation in the aforementioned hollow interiors is not promoted when the conveying performance is partly restrained in the first and second conveyor screws 72, 73 having the hollowing shape.

As just described, in this embodiment, the 11$^{th}$ projections 728 and the 21$^{st}$ projections 738 are arranged, whereby the developer conveying performances of the first and second conveyor screws 72, 73 are partly restrained. Thus, even if the conveying performances of the first and second screws 721, 731 partly differ in the developer storage of the developing device 70, differences in the conveying performances are reduced by arranging the 11$^{th}$ and 21$^{st}$ projections 728, 738.

Note that the 11$^{th}$ and 21$^{st}$ projections 728, 738 are arranged on radially outer wall parts of the 12$^{th}$ and 22$^{nd}$ ribs 723, 733. Thus, changes in molds for forming the first and second conveyor screws 72, 73 are suppressed to a minimum level in the case of adding or deleting the 11$^{th}$ and 21$^{st}$ projections 728, 738 as compared with the case where the pitches or outer diameters of the spiral parts of the first and second screws 721, 731 are changed. As a result, a variation in the conveying performance as described above can be restrained while cost of the first and second conveyor screws 72, 73 is suppressed as compared with the case where the pitches or outer diameters of the spiral parts of the first and second screws 721, 731 are changed. Particularly, even if the specification of a processing speed (linear speed) is changed in the image forming apparatus 1, the developer conveying performance can be inexpensively adjusted by changing the shapes of the 11$^{th}$ and 21$^{st}$ projections 728, 738.

Note that in another embodiment of the developing device 70, the 21$^{st}$ projections 738Z may be distributed on the second conveyor screw 73Z as shown in FIG. 12 and the 11$^{th}$ projections 728Z may be distributed on the first conveyor screw 72Z as shown in FIG. 13. The developer conveyed in the second conveying portion 74*b* tends to be restricted by a magnetic force of the developing roller 71. Thus, the developer conveying performance in the axial direction of the second conveying portion 74*b* tends to be lower than the developer conveying performance in the axial direction of the first conveying portion 74*a*. In such a case, the developer conveying performance in the first conveying portion 74*a* is more restrained by arranging more 11$^{th}$ projections 728Z of the first conveyor screw 72Z than the 21$^{st}$ projections 738Z of the second conveyor screw 73Z as shown in FIGS. 12 and 13. Thus, the developer conveying performances of the first and second conveying portions 74*a*, 74*b* can be approximated. As a result, the developer is stably moved in a circulating manner in the developer storage 74.

Further, a partial variation in the conveying performance of the first conveyor screw 72 can be compensated by setting different shapes for the 11$^{th}$ projections 728 depending on the positions of the first conveyor screw 72 where the 11$^{th}$ projections 728 are arranged as shown in FIGS. 14 and 15. In this case, the axial lengths or radial height of the 11$^{th}$ projections 728 may be changed.

Further, as described above, the 11$^{th}$ projection 728 projects in the developer conveying direction (arrow D14 of FIG. 14, arrow D15 of FIG. 15) from one spiral part of the first conveyor screw 72 in the axial direction. An axial tip part of the 11$^{th}$ projection 728 in the conveying direction is arranged between adjacent spiral blades. Thus, as shown in FIG. 15, predetermined clearances T are formed at downstream sides of the axial tip parts of the $11^{th}$ projections 728 in the conveying direction (arrow D15 of FIG. 15). As a result, a partial variation in the conveying performance caused when the developer is deteriorated and the fluidity thereof is reduced can be prevented. In other words, if the $11^{th}$ projections 728 extend in the entire areas between adjacent spiral blades of the first conveyor screw 72 in the axial direction, the developer adheres to the $11^{th}$ projections 728 and the conveying performance is considerably reduced when the fluidity of the developer is reduced to increase an adhesion force of the developer. On the other hand, by forming the clearances T as described above, the stay of an excessive amount of the developer at the same position on the spiral blade is suppressed and the adhesion of the developer is prevented. Note that a configuration similar to the above is applicable also to the $21^{st}$ projections 738 of the second conveyor screw 73.

As described above, in this embodiment, the developing device 70 includes the developer housing 70A with the pair of first and second wall portions 70B, 70C, the developer storage 74 (first and second conveying portions 74*a*, 74*b*) extending between the pair of wall portions, and the first and second conveyor screws 72, 73 rotatably supported on the wall portions and configured to convey the developer from one wall portion to the other. The first conveyor screw 72 includes the $11^{th}$ and $12^{th}$ shaft portions 726, 727, the first screw 721, the $11^{th}$ and $12^{th}$ ribs 722, 723 and the $11^{th}$ connecting piece 724. The $11^{th}$ and $12^{th}$ shaft portions 726, 727 are arranged to face the first and second wall portions 70B, 70C, rotatably supported on the wall portions and serve as the rotary shaft for the rotation of the first conveyor screw 72. Further, the first screw 721 includes the hollow interior, spirally extends in the developer conveying direction and forms the outer peripheral edge of the first conveyor screw 72. The first screw 721 includes the first inner wall portion 721S with the plurality of inner wall surfaces which define the hollow interior and are connected at the predetermined angles in the circumferential direction of the rotation of the first conveyor screw 72. The $11^{th}$ and $12^{th}$ ribs 722, 723 extend in the conveying direction and connect the spiral parts of the first screw 721 arranged adjacent to each other in the conveying direction. Further, the $11^{th}$ connecting piece 724 is arranged to face the second wall portion 70C and connects the end parts of the $11^{th}$ and $12^{th}$ ribs 722, 723 in the conveying direction to the $11^{th}$ shaft portion 726. When the interior of the developer housing 70A gets hot or the developer is deteriorated, the fluidity of the developer being conveyed in the developer storage 74 may be reduced. In this case, the developer tends to stay in the hollow interior of the first screw 721. Even in such a case, according to the above configuration, the first inner wall portion 721S of the first screw 721 applies a cyclically varying pressure to the developer arranged in the hollow interior as the first screw 721 is rotated. Thus, an aggregate of the developer tends to collapse in the hollow interior. As a result, the cylindrical aggregation of the developer in the hollow interior is suppressed.

Further, in the above embodiment, the plurality of inner wall surfaces forming the first inner wall portion 721S are connected at the constant angle in the circumferential direction. Thus, as many inner wall surfaces as possible are arranged on the inner wall portion of the first conveyor screw 72 in the axial direction of the first conveyor screw 72. As a result, the aggregation of the developer can be suppressed along the axial direction of the first conveyor screw 72.

Further, in the above embodiment, the $11^{th}$ and $12^{th}$ ribs 722, 723 are plate-like members having a width in the circumferential direction. Out of the $11^{th}$ and $12^{th}$ ribs 722, 723, the inner surface portions facing the hollow interior form some of the plurality of inner wall surfaces of the first screw 721. This prevents the plurality of inner wall surfaces from being interrupted at the arrangement positions of the $11^{th}$ and $12^{th}$ ribs 722, 723 in the circumferential direction of the first screw 721. Thus, the aggregation of the developer can be further suppressed in the hollow interior.

Further, in the above embodiment, the $11^{th}$ and $12^{th}$ ribs 722, 723 as a plurality of rib members are arranged at intervals in the circumferential direction. Thus, the first screw 721 is stably supported by the plurality of rib members. As a result, the rotation of the first conveyor screw 72 is stably maintained.

Further, in the above embodiment, the first inner wall portion 721S of the first screw 721 applies a pressure, whose magnitude cyclically varies, to the developer arranged in the hollow interior as the first screw 721 is rotated in the developing device 70. Thus, an aggregate of the developer tends to collapse in the hollow interior. As a result, the cylindrical aggregation of the developer in the hollow interior is suppressed. Furthermore, the adhesion of an aggregate of the developer to the developing roller 71 is prevented.

Further, in the above embodiment, the cylindrical aggregation of the developer in the developing device 70 is suppressed even if the developer used in the developing device 70 is one-component developer. In two-component developer composed of carrier and toner, the carrier collides with the toner and the toner is less likely to aggregate as compared with one-component developer as the developer is agitated. On the other hand, an action as described above is less likely to occur with one-component developer and the developer tends to cylindrically aggregate in the hollow interior of the first screw 721. Even in such a case, the aggregation of the one-component developer is effectively suppressed by the first inner wall portion 721S of the first screw 721.

Further, in the above embodiment, the cylindrical aggregation of the developer in the hollow interior of the first screw 721 is suppressed in the image forming apparatus 1 including the developing device 70. Thus, the adhesion of an aggregate of the developer to the developing roller 71 is prevented. Therefore, the supply of an aggregate of the developer to the photoconductive drum 31 is suppressed and image quality defects are effectively suppressed.

Although the developing device 70 and the image forming apparatus 1 including this according to the embodiment of the present invention are described above, the present invention is not limited to this and can be, for example, modified as follows.

(1) Although the developer conveying device is described using the interior of the developing device 70 in the above embodiment, the present invention is not limited to this. A developer conveying device including the first or second conveyor screw 72 or 73 may be applied to a toner container, a toner cartridge, a waste toner conveying device or the like. Even in this case, the cylindrical aggregation of developer is suppressed in the hollow interior of the first or second screw 721 or 731.

(2) Although the first and second conveyor screws 72, 73 are supported on the developer housing 70A at the opposite axial end parts in the above embodiment, the present invention is not limited to this. The first and second conveyor screws 72, 73 may be supported on the developer housing 70A at one axial ends.

(3) Although the first inner wall portion 721S of the first conveyor screw 72 and the second inner wall portion 731S of the second conveyor screw 73 are described to have a regular octagonal shape in a cross-section in the above embodiment, the present invention is not limited to this. The first and second inner wall portions 721S, 731S may be formed by connecting a plurality of planar portions at predetermined angles. In this case, all the angles between the connected planar portions may not be the same.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer conveying device, comprising:

a housing with a pair of wall portions;

a developer conveyance path extending between the pair of wall portions; and a conveying member rotatably supported on the wall portions and configured to convey developer from one wall portion to the other;

wherein the conveying member includes:

a spiral member having opposite first and second end parts and being formed by connecting spiral pieces, each of the spiral pieces forming one spiral turn, in a conveying direction of the developer and including a hollow interior formed by the connected spiral pieces;

an inner wall portion including a plurality of planar portions which define the hollow interior of the spiral member and are connected at predetermined angles in a circumferential direction of the rotation of the conveying member in a cross-section intersecting an axial direction of the conveying member, the planar portions constituting inner surfaces of the spiral pieces;

first and second shaft portions arranged respectively at the opposite first and second end parts of the spiral member, rotatably supported on the wall portions and serving as a rotary shaft for the rotation of the conveying member;

the hollow interior is formed between the first and second shaft portions; and the conveying member has no other shaft part in the hollow interior.

2. A developer conveying device according to claim 1, wherein:

the plurality of planar portions are connected at a plurality of connecting portions in the circumferential direction; and the plurality of connecting portions connect the plurality of planar portions at the same angle.

3. A developer conveying device according to claim 1, further comprising:

a rib member extending in the conveying direction and bridging adjacent ones of the spiral pieces of the spiral member; and a supporting member arranged to face the wall portion and connecting an end part of the rib member in the conveying direction and the shaft portion.

4. A developer conveying device according to claim 3, wherein:

the rib member is composed of a plate-like member having a width in the circumferential direction; and an inner surface portion of the rib member facing the hollow interior forms some of the plurality of planar portions of the spiral member.

5. A developer conveying device according to claim 3, wherein a plurality of the rib members are arranged at intervals in the circumferential direction.

6. A developing device, comprising;

a housing with a pair of wall portions;

a developer conveyance path extending between the pair of wall portions;

a conveying member rotatably supported on the wall portions and configured to convey developer from one wall portion to the other; and a developing roller rotatably supported in the housing and configured to carry the developer;

wherein the conveying member includes:

a spiral member having opposite first and second end parts and being formed by connecting spiral pieces, each of the spiral pieces forming one spiral turn, in a conveying direction of the developer and including a hollow interior formed by the connected spiral pieces;

an inner wall portion including a plurality of planar portions which define the hollow interior of the spiral member and are connected at predetermined angles in a circumferential direction of the rotation of the conveying member in a cross-section intersecting an axial direction of the conveying member, the planar portions constituting inner surfaces of the spiral pieces;

first and second shaft portions arranged respectively at the opposite first and second end parts of the spiral member, rotatably supported on the wall portions and serving as a rotary shaft for the rotation of the conveying member;

the hollow interior is formed between the first and second shaft portions; and the conveying member has no other shaft part in the hollow interior.

7. A developing device according to claim 6, wherein the developer is composed of one-component developer.

8. A developing device according to claim 6, wherein:

the plurality of planar portions are connected at a plurality of connecting portions in the circumferential direction; and the plurality of connecting portions connect the plurality of planar portions at the same angle.

9. A developing device according to claim 6, further comprising:

a rib member extending in the conveying direction and bridging adjacent ones of the spiral pieces of the spiral member; and a supporting member arranged to face the wall portion and connecting an end part of the rib member in the conveying direction and the shaft portion.

10. A developing device according to claim 9, wherein:

the rib member is composed of a plate-like member having a width in the circumferential direction; and an inner surface portion of the rib member facing the hollow interior forms some of the plurality of planar portions of the spiral member.

11. A developing device according to claim 9, wherein a plurality of the rib members are arranged at intervals in the circumferential direction.

12. An image forming apparatus, comprising:

a housing with a pair of wall portions;

a developer conveyance path extending between the pair of wall portions;

a conveying member rotatably supported on the wall portions and configured to convey developer from one wall portion to the other;

a developing roller rotatably supported in the housing and configured to carry the developer; and an image bearing member configured such that an electrostatic latent image is to be formed on a circumferential surface thereof, and arranged to face the developing roller;

wherein the conveying member includes:

a spiral member having opposite first and second end parts and being formed by connecting spiral pieces, each of the spiral pieces forming one spiral turn, in a conveying direction of the developer and including a hollow interior formed by the connected spiral pieces;

an inner wall portion including a plurality of planar portions which define the hollow interior of the spiral member and are connected at predetermined angles in a circumferential direction of the rotation of the conveying member in a cross-section intersecting an axial direction of the conveying member, the planar portions constituting inner surfaces of the spiral pieces;

first and second shaft portions arranged respectively at the opposite first and second end parts of the spiral member, rotatably supported on the wall portions and serving as a rotary shaft for the rotation of the conveying member the hollow interior is formed between the first and second shaft portions; and the conveying member has no other shaft part in the hollow interior.

13. An image forming apparatus according to claim 12, wherein the developer is composed of one-component developer.

14. An image forming apparatus according to claim 12, wherein:

the plurality of planar portions are connected at a plurality of connecting portions in the circumferential direction; and the plurality of connecting portions connect the plurality of planar portions at the same angle.

15. An image forming apparatus according to claim 12, further comprising:

a rib member extending in the conveying direction and bridging adjacent ones of the spiral pieces of the spiral member; and a supporting member arranged to face the wall portion and connecting an end part of the rib member in the conveying direction and the shaft portion.

16. An image forming apparatus according to claim 15, wherein:

the rib member is composed of a plate-like member having a width in the circumferential direction; and an inner surface portion of the rib member facing the hollow interior forms some of the plurality of planar portions of the spiral member.

17. An image forming apparatus according to claim 15, wherein a plurality of the rib members are arranged at intervals in the circumferential direction.

* * * * *